US011126127B2

(12) United States Patent
Takayama

(10) Patent No.: US 11,126,127 B2
(45) Date of Patent: Sep. 21, 2021

(54) SHEET CONVEYING DEVICE AND IMAGE FORMING APPARATUS INCORPORATING THE SHEET CONVEYING DEVICE

(71) Applicant: Hideyuki Takayama, Kanagawa (JP)

(72) Inventor: Hideyuki Takayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/694,006

(22) Filed: Nov. 25, 2019

(65) Prior Publication Data

US 2020/0174415 A1 Jun. 4, 2020

(30) Foreign Application Priority Data

Nov. 30, 2018 (JP) ..... JP2018-225289

(51) Int. Cl.
*B65H 3/06* (2006.01)
*G03G 15/00* (2006.01)
*B65H 5/06* (2006.01)

(52) U.S. Cl.
CPC ..... *G03G 15/6529* (2013.01); *B65H 3/0607* (2013.01); *B65H 5/06* (2013.01)

(58) Field of Classification Search
CPC .. B65H 3/0607; B65H 3/0669; B65H 3/0684; B65H 5/06; G03G 15/6529
See application file for complete search history.

(56) References Cited

U.S. PATENT DOCUMENTS 7,007,945 B2 * 3/2006 Hiramitsu ..... B65H 3/0623 271/122
7,455,286 B2 * 11/2008 Klaffenbach ..... B65H 3/5261 271/114
8,695,776 B2 * 4/2014 Cha ..... G07D 11/14 194/206
2016/0159598 A1 6/2016 Yamane et al.
2017/0320688 A1 * 11/2017 Nishizawa ..... B65H 7/02
(Continued)

FOREIGN PATENT DOCUMENTS

EP 3243775 A1 11/2017
JP 6-191686 * 7/1994
(Continued)

OTHER PUBLICATIONS

Extended European Search Report dated May 29, 2020 issued in corresponding European Application No. 19209613.9.

*Primary Examiner* — Thomas A Morrison
(74) *Attorney, Agent, or Firm* — Harness, Dickey & Pierce, P.L.C.

(57) ABSTRACT

A sheet conveying device includes a sheet pickup body, a first sheet conveyor, and a second sheet conveyor, which are disposed in this order along a sheet conveyance direction, and circuitry. The first sheet conveyor includes a first sheet feed roller, a second sheet feed roller, and a first motor. The second sheet conveyor includes a conveyance roller and a second motor. The circuitry is configured to determine a sheet conveyance state of a sheet based on at least one of torque of the first motor of the first sheet conveyor and torque of the second motor of the second sheet conveyor. The first sheet conveyor is configured to interpose the sheet between the first sheet feed roller and the second sheet feed roller and convey the sheet to the second sheet conveyor as the first sheet feed roller rotates.

11 Claims, 16 Drawing Sheets

(56) References Cited

U.S. PATENT DOCUMENTS

| | | | |
|---|---|---|---|
| 2017/0341892 | A1 | 11/2017 | Yamane et al. |
| 2018/0241896 | A1 | 8/2018 | Watanabe et al. |
| 2018/0273323 | A1 | 9/2018 | Yamane et al. |
| 2018/0362278 | A1 | 12/2018 | Matsuda et al. |

FOREIGN PATENT DOCUMENTS

| | | |
|---|---|---|
| JP | 10-045272 | 2/1998 |
| JP | 2014-125347 | 7/2014 |
| JP | 2016-104663 A | 6/2016 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2018-225289, filed on Nov. 30, 2018, in the Japan Patent Office, the entire disclosure of which is hereby incorporated by reference herein.

BACKGROUND

Technical Field

This disclosure relates to a sheet conveying device and an image forming apparatus incorporating the sheet conveying device.

Discussion of the Background Art

Various types of sheet conveying devices are known to include a configuration in which the ratio of the amount of movement of a sheet per a unit time detected in each of a plurality of sections in which respective detection time zones do not overlap each other is calculated based on a detection result of a sheet movement amount detector that detects an amount of movement of a sheet, and deterioration of a sheet conveyance member is determined based on the result of comparison of the calculated value of the ratio of the amount of movement of the sheet and a reference value.

SUMMARY

At least one aspect of this disclosure provides a sheet conveying device including a sheet pickup body, a first sheet conveyor, a second sheet conveyor, and circuitry. The first sheet conveyor includes a first sheet feed roller, a second sheet feed roller, and a first motor configured to rotate the first sheet feed roller. The second sheet conveyor includes a conveyance roller, and a second motor configured to rotate the conveyance roller. The circuitry is configured to determine a sheet conveyance state of a sheet based on at least one of torque of the first motor of the first sheet conveyor and torque of the second motor of the second sheet conveyor. The sheet pickup body, the first sheet conveyor, and the second sheet conveyor are disposed in this order along a sheet conveyance direction. The first sheet conveyor is configured to interpose the sheet between the first sheet feed roller and the second sheet feed roller and convey the sheet to the second sheet conveyor as the first sheet feed roller rotates.

Further, at least one aspect of this disclosure provides an image forming apparatus including the above-described sheet conveying device and an image forming device configured to form an image on the sheet conveyed by the sheet conveying device.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 6 including

Figure 1:
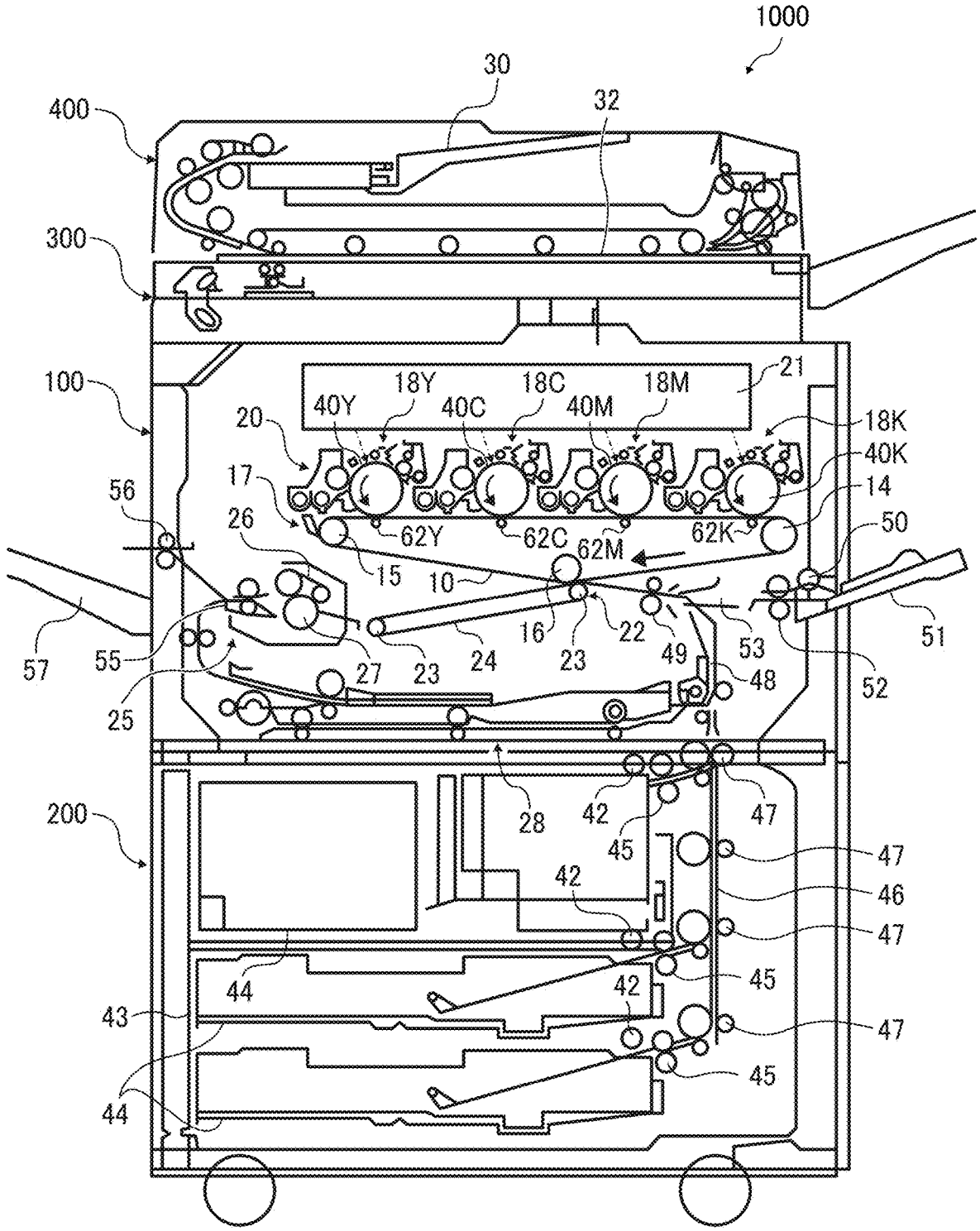
FIG. 1 is a cross-sectional view illustrating an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet conveying device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet conveying device and image forming apparatus and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of a sheet conveying device according to an embodiment of this disclosure.

FIG. 1 is a cross-sectional view illustrating an image forming apparatus according to an embodiment of this disclosure. To be more specific, FIG. 1 illustrates a schematic entire configuration of an internal mechanism of an example of a tandem-type electrophotographic color image forming apparatus of an indirect transfer method (hereinafter, simply referred to as an image forming apparatus 1000).

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic copier that forms toner images on recording media by supplying toner to the recording media.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveyance direction" indicates a direction in which a recording medium travels from an upstream side of a sheet conveying path to a downstream side thereof; the term "width direction" indicates a direction basically perpendicular to the sheet conveyance direction.

As illustrated in FIG. 1, the image forming apparatus 1000 includes a housing 100, a sheet conveying device 200, a scanner 300, and an automatic document feeder (ADF) 400. The housing 100 is a main body of the image forming apparatus 1000. The housing 100 is installed on the sheet conveying device 200. The scanner 300 is attached on the housing 100. The ADF 400 is attached on the scanner 300.

The housing 100 includes an intermediate transfer member 10, a drive roller 14, and two driven rollers 15 and 16. The intermediate transfer member 10 is an endless belt and is wound around the drive roller 14 and the driven rollers 15 and 16. The intermediate transfer member 10 is disposed at the center of the housing 100 of the image forming apparatus 1000 to be rotatable endlessly in a clockwise direction in FIG. 1. The configuration of the intermediate transfer member 10, however, is not limited to the above-described configuration. For example, the intermediate transfer member 10 may be wound around four or more rollers including a roller or rollers to adjust deviation of the intermediate transfer member 10. It is to be noted that the intermediate transfer member 10 is stretched to be substantially horizontal in FIG. 1. However, the intermediate transfer member 10 may be stretched to be oblique to the housing 100.

In FIG. 1, the image forming apparatus 1000 further includes a belt cleaning device 17 on the left side of the driven roller 15. The belt cleaning device 17 removes residual toner remaining on the surface of the intermediate transfer member 10 after transfer of an image to a sheet such as a recording medium.

The housing 100 of the image forming apparatus 1000 further includes a tandem image forming device 20 and an optical writing device 21. The tandem image forming device 20 is disposed above the intermediate transfer member 10 that is horizontally stretched between the drive roller 14 and the driven roller 15. The tandem image forming device 20 includes four single color image forming units 18Y, 18C, 18M, and 18K of yellow, cyan, magenta, and black colors, aligned in this order along a belt conveyance direction, on an upper side stretched region of the intermediate transfer member 10 between the drive roller 14 and the driven roller 15. The optical writing device 21 is provided above the tandem image forming device 20.

On the other hand, a secondary transfer device 22 is provided on a lower side stretched region of the intermediate transfer member 10. In the image forming apparatus 1000 illustrated in FIG. 1, the secondary transfer device 22 includes two rollers 23 and a secondary transfer belt 24 stretched around two rollers 23. The secondary transfer belt 24 is an endless belt. The secondary transfer device 22 contacts, to be more specific, presses against the driven roller 16 to transfer an image formed on the intermediate transfer member 10 onto a sheet (a recording medium).

A fixing device 25 is disposed next to, to be more specific, downstream from the secondary transfer device 22 in a sheet conveyance direction of the sheet P (hereinafter referred to as a sheet conveyance direction). The fixing device 25 fixes the image transferred onto the sheet P, to the sheet P. The fixing device 25 includes a fixing belt 26 and a pressure roller 27. The pressure roller 27 is pressed against the fixing belt 26 that is an endless belt. In the image forming apparatus 1000 illustrated in FIG. 1, a part of the fixing device 25 is disposed below the lower stretched region of the intermediate transfer member 10. Alternatively, the whole fixing device 25 may be disposed the lower stretched region of the intermediate transfer member 10. The secondary transfer device 22 also has a sheet conveyance function to convey a sheet (recording medium) having an image after image transfer, to the fixing device 25. However, the configuration of the secondary transfer device 22 is not limited to the above-described configuration. For example, a non-contact-type charger may be disposed as the secondary transfer device 22. However, in this configuration, it is difficult to provide this sheet conveyance function in the secondary transfer device 22.

The image forming apparatus 1000 illustrated in FIG. 1 further includes a sheet reversing device 28 below the secondary transfer device 22 and the fixing device 25. The sheet reversing device 28 is disposed parallel to a stretching direction of the intermediate transfer member 10 to reverse a sheet to form images on both sides (both faces) of the sheet.

When making a copy or copies of an original document with the image forming apparatus 1000, a user, for example, places the original document on a document loading table 30 of the ADF 400. Alternatively, the user may lift and open the ADF 400, place the original document directly on the exposure glass 32 of the scanner 300, and lower and close the ADF 400 to cause the ADF 400 to press the original document against the exposure glass 32. In a case in which the original document is set on the ADF 400, as a start button of the image forming apparatus 1000 is pressed, the original document is conveyed from the ADF 400 to the exposure glass 32 of the scanner 300. Then, the scanner 300 is driven to read data of the original document. In a case in which the original document is placed directly on the exposure glass 32, the data of the original document is read immediately.

As the start button is pressed, a drive motor drives the drive roller 14, and the driven rollers 15 and 16 are rotated together with the drive roller 14. Along with the rotations of the drive roller 14 and the driven rollers 15 and 16, the intermediate transfer member 10 are rotated. At the same time, photoconductors 40Y, 40C, 40M, and 40K of single-color image forming units 18Y, 18C, 18M, and 18K of the tandem image forming device 20 are rotated, so as to develop respective latent images into visible single-color toner images of yellow, cyan, magenta, and black. Then, along with rotation of the intermediate transfer member 10, the respective single-color toner images of yellow, cyan, magenta, and black are sequentially transferred onto the intermediate transfer member 10 as primary transfer. By so doing, the respective single-color toner images are overlaid for forming a composite color image on the intermediate transfer member 10.

On the other hand, after the start button is pressed, one of pickup rollers 42 that are provided in the sheet conveying device 200 is selected to rotate at a given timing. In response to this rotation of the one of the pickup rollers 42, sheets (recording media) including a sheet (recording medium) P are fed out from one of sheet loading trays 44 that are provided in multiple stages in a paper bank 43 that is also provided in the sheet conveying device 200. The sheets (recording media) are separated one by one by a separation roller 45. Then, the sheet P separated from the sheet is fed into a sheet conveyance passage 46. Then, the sheet P is conveyed by pairs of conveyance rollers 47, and is guided to a sheet conveyance passage 48 in the housing 100 of the image forming apparatus 1000. Then, the sheet P contacts a pair of registration rollers 49 before stopping. Alternatively, in a case in which a sheet (recording medium) P is fed as bypass feeding, the user opens a bypass tray 51 from the housing 100, and sets sheets (recording media) including the sheet P on the bypass tray 51. The sheets are fed by a sheet feed roller 50, and separated by a separation roller 52 one by one (if multiple sheets are fed at the same time). The sheet P is fed into a bypass sheet feed passage 53, and stopped by contacting the pair of registration rollers 49.

Subsequently, the pair of registration rollers 49 is rotated again in synchronization with movement of the composite color image formed on the intermediate transfer member 10, so that the sheet P is conveyed between the intermediate transfer member 10 and the secondary transfer device 22. Then, in the secondary transfer device 22, the composite color image on the intermediate transfer member 10 is transferred onto the sheet P for secondary transfer, thereby forming a color image on the sheet P.

After the composite color image has been transferred, the sheet P is conveyed by the secondary transfer device 22 to the fixing device 25. The fixing device 25 fixes the composite color image on the sheet P, to the sheet P by application of heat and pressure. Thereafter, a switching claw 55 switches the direction of the sheet P. Then, the sheet P is conveyed by a pair of sheet ejection rollers 56 to be stacked in a sheet ejection tray 57. In a case in which images are formed on both sides (both faces) of the sheet P, the switching claw 55 switches the direction of the sheet P to guide the sheet P to the sheet reversing device 28 where the sheet P is reversed and then guided to the transfer position again. After an image is formed on the back face (back side) of the sheet P, the sheet P is ejected by the pair of sheet ejection rollers 56 onto the sheet ejection tray 57.

On the other hand, the intermediate transfer member 10 has residual toner remaining on the surface after the secondary transfer. The belt cleaning device 17 removes the residual toner from the surface of the intermediate transfer member 10 to clean the intermediate transfer member 10 for subsequent image formation by the tandem image forming device 20.

Figure 2:
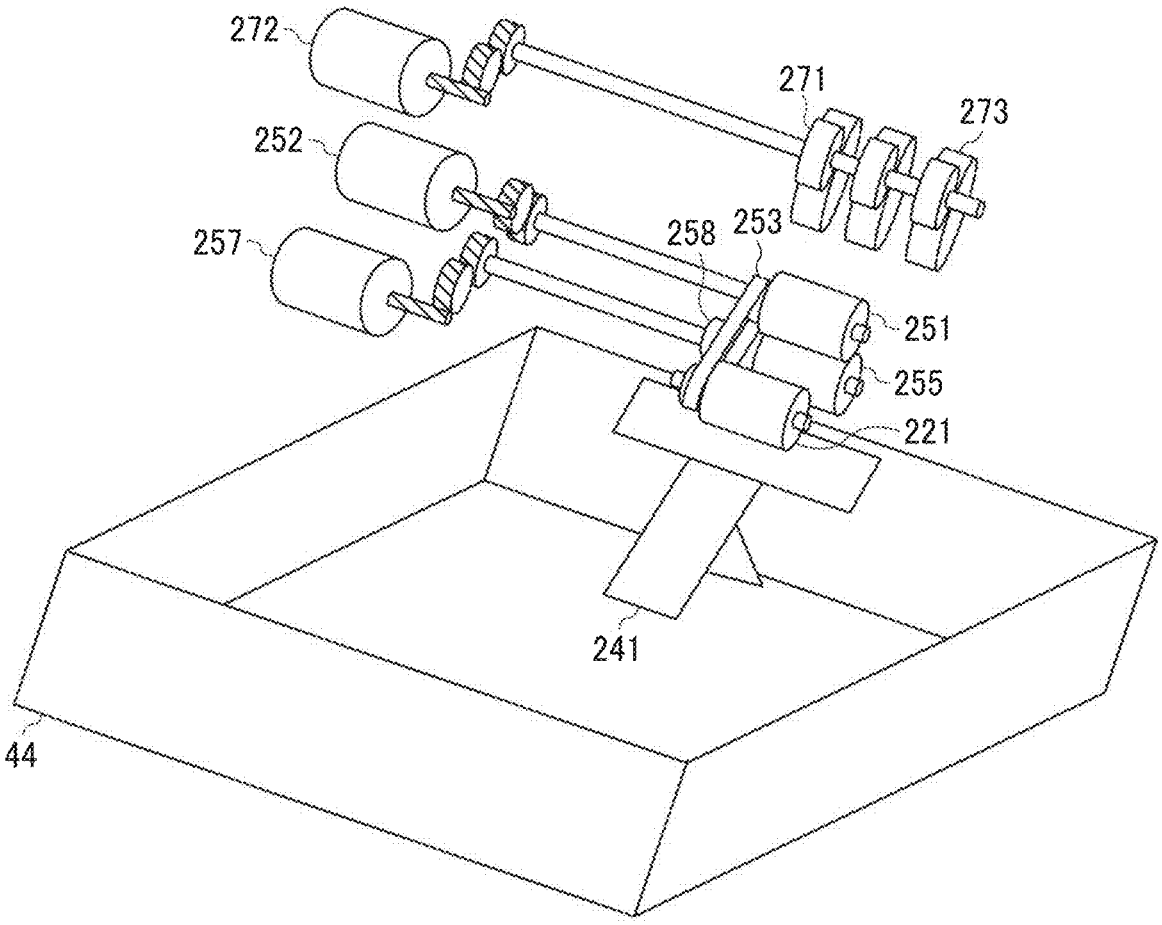
FIG. 2 is a diagram illustrating a schematic configuration of a sheet conveying device according to an embodiment of this disclosure.

FIG. 2 is a diagram illustrating a schematic configuration of the sheet conveying device 200 according to an embodiment of this disclosure.

The sheet conveying device 200 sequentially includes, in this order along a sheet conveyance direction, a pickup roller 221, a sheet feed roller 251, a sheet separation roller 255, a sheet feed motor 252, a sheet conveyance roller 271, a sheet conveyance motor 272, and a conveyance roller opposing belt 273. The pickup roller 221 functions as an example of a sheet feed body that supplies a sheet (e.g., the sheet P). The sheet feed roller 251 functions as an example of a first sheet feed roller. The sheet separation roller 255 functions as an example of a second sheet feed roller. The sheet feed motor 252 functions as an example of a first motor that rotates the sheet feed roller 251. The sheet conveyance motor 272 functions as an example of a second motor that rotates the sheet conveyance roller 271. The conveyance roller opposing belt 273 conveys a sheet (e.g., the sheet P) by rotations of the sheet conveyance roller 271 with the sheet interposed between the sheet conveyance roller 271 and the conveyance roller opposing belt 273. It is to be noted that the pickup roller 221 has the same function as the pickup roller 42 and the sheet separation roller 255 has the same function as the separation roller 45.

The sheet feed roller 251, the sheet separation roller 255, and the sheet feed motor 252 form a first sheet conveyance unit. The sheet conveyance roller 271, the sheet conveyance motor 272, and the conveyance roller opposing belt 273 form a second sheet conveyance unit.

The first sheet conveyance unit holds (grips) the sheet between the sheet feed roller 251 and the sheet separation roller 255, so that the sheet is conveyed to the second sheet conveyance unit along with rotations of the sheet feed roller 251.

The sheet conveying device 200 further includes a sheet loading tray 44, a sheet lifting plate 241, a timing belt 253, a sheet separation motor 257, and a torque limiter 258. The sheet loading tray 44 loads the sheet or sheets. The sheet lifting plate 241 lifts the sheet loaded on the sheet loading tray 44 toward the pickup roller 221. The timing belt 253 transmits rotations of the sheet feed motor 252 to the pickup roller 221. The sheet separation motor 257 rotates the sheet separation roller 255 in an opposite direction to the sheet conveyance direction. The torque limiter 258 limits (regulates) rotation torque of the sheet separation roller 255.

Figure 3:
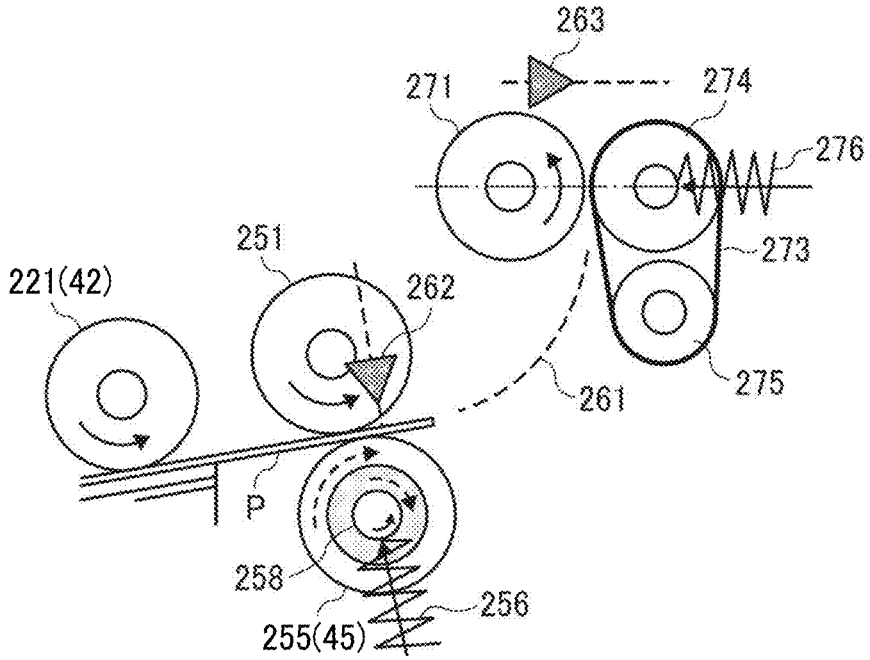
FIG. 3 is a cross-sectional view illustrating the configuration of the sheet conveying device according to the present embodiment of this disclosure.

FIG. 3 is a cross-sectional view illustrating the configuration of the sheet conveying device 200 according to the present embodiment of this disclosure.

The sheet conveying device 200 further includes a first conveyance sensor 262, a sheet separation roller biasing member 256, a sheet conveyance guide 261, a conveyance opposing roller 274, a sheet conveyance opposing second roller 275, a sheet conveyance opposing roller biasing member 276, and a second conveyance sensor 263. The first conveyance sensor 262 detects the sheet that is being conveyed from the first sheet conveyance unit. The sheet separation roller biasing member 256 biases the sheet separation roller 255 toward the sheet feed roller 251. The sheet conveyance guide 261 is configured to guide the sheet that is fed out from the first sheet conveyance unit, to the second sheet conveyance unit. The conveyance opposing roller 274 is disposed facing the sheet conveyance roller 271 via the conveyance roller opposing belt 273. The conveyance opposing roller 274 and the sheet conveyance opposing second roller 275 are wound with the conveyance roller opposing belt 273. The sheet conveyance opposing roller biasing member 276 biases the conveyance opposing roller 274 toward the sheet conveyance roller 271. The second conveyance sensor 263 detects the sheet (e.g., the sheet P) that is being conveyed from the second sheet conveyance unit.

The first conveyance sensor 262 is disposed immediate below the shaft of the sheet feed roller 251 or disposed slightly downstream from the shaft of the sheet feed roller 251 in the sheet conveyance direction, as illustrated in FIG. 3.

The second conveyance sensor 263 is disposed immediate below the shaft of the sheet conveyance roller 271 or disposed slightly downstream from the shaft of the sheet conveyance roller 271 in the sheet conveyance direction, as illustrated in FIG. 3.

The sheet conveyance guide 261 is curved so that the surface on the side where the sheet is conveyed is inward. In other words, the sheet conveyance guide 261 has an inwardly curved surface along which the sheet is conveyed. In FIG. 3, the sheet conveyed from the first sheet conveyance unit is further conveyed in an upward direction.

With the above-described configuration of the sheet conveying device 200, in a case in which a sheet (e.g., the sheet P) is fed, the sheet lifting plate 241 that is disposed in the sheet loading tray 44 is lifted. By so doing, the sheet (or sheets) loaded on the sheet lifting plate 241 is lifted to cause an uppermost sheet on the sheet lifting plate 241 to be pressed against the pickup roller 221. At this time, when the sheet contacts the pickup roller 221 (in other words, the sheet is pressed against the pickup roller 221) by application of pressure within a predetermined amount, the sheet lifting plate 241 stops lifting. A sensor is provided to detect that the uppermost sheet has contacted (has been pressed against) the pickup roller 221. In a case in which the sheet is not fed, the sheet lifting plate 241 may be lowered, in other words, may be located at the home position.

In the sheet conveying device 200, in a case in which the pickup roller 221 is rotated in the sheet conveyance direction in a state in which the uppermost sheet is pressed against the pickup roller 221 (in other words, the uppermost sheet is in contact with the pickup roller 221), the uppermost sheet is fed out from the sheet loading tray 44. As the sheet feed motor 252 that functions as a drive source of the sheet feed roller 251 is rotated, the rotations of the sheet feed motor 252 is transmitted to the pickup roller 221 via the timing belt 253, thereby rotating the pickup roller 221.

The sheet that has been fed out from the sheet loading tray 44 enters a portion (i.e., a nip region) where the sheet feed roller 251 and the sheet separation roller 255 are pressed against each other.

The sheet feed roller 251 is rotated by the sheet feed motor 252 to feed out the sheet in the sheet conveyance direction. The sheet feed roller 251 and the sheet separation roller 255 press and hold the sheet together.

The sheet separation roller 255 is driven and rotated by the sheet separation motor 257 via a drive transmission unit including the torque limiter 258.

The sheet separation motor 257 drives the sheet separation roller 255 to rotate in the opposite direction to the sheet conveyance direction. However, with the torque limiter 258, in a case in which force that exceeds the upper limit value of the torque limiter 258 is applied to the surface of the sheet separation roller 255, the sheet separation roller 255 is rotated along with the sheet feed roller 251 (in other words, the sheet separation roller 255 is rotated in the sheet conveyance direction).

By contrast, in a case in which the force does not exceed the upper limit value of the torque limiter 258, the sheet separation roller 255 is rotated in the opposite direction to the sheet conveyance direction. Consequently, in a case in which a plurality of sheets are fed in layers by the pickup roller 221, the plurality of sheets that have excessively been fed from the pickup roller 221 are returned to the sheet loading tray 44. In other words, the plurality of sheets other than the uppermost sheet are returned to the sheet loading tray 44. This operation is made because the friction between the sheets is smaller than the friction between the sheet separation roller 255 and the sheet. Accordingly, the first sheet conveyance unit feeds out the sheet one by one.

It is to be noted that the drive source of the sheet separation roller 255 is not disposed to be dedicated to the sheet separation motor 257 but may share with the sheet feed motor 252 or the sheet conveyance motor 272. Details of the sheet conveyance motor 272 are described below.

In the sheet conveying device 200, the sheet is fed from the first sheet conveyance unit and is then pressed and held by the sheet conveyance roller 271 and the conveyance roller opposing belt 273 in pairs. Then the sheet is conveyed in the sheet conveyance direction while being held by the sheet conveyance roller 271 and the conveyance roller opposing belt 273 in pairs. As the sheet conveyance roller 271 is rotated by the sheet conveyance motor 272, the conveyance roller opposing belt 273 is rotated along the sheet conveyance roller 271. Here, the pressure (force) of the sheet conveyance opposing roller biasing member 276 applies pressure (force) to press the conveyance roller opposing belt 273 against the sheet conveyance roller 271. The pressure (force) of the sheet conveyance opposing roller biasing member 276 is greater than the pressure (force) of the sheet separation roller biasing member 256 to press the sheet separation roller 255 against the sheet feed roller 251.

If the sheet conveyance passage from the first sheet conveyance unit to the second sheet conveyance unit is not straight (linear) or is straight with a long distance, the sheet conveyance guide 261 is disposed. Even if the sheet conveyance passage from the first sheet conveyance unit to the second sheet conveyance unit is straight with a short distance, the sheet conveyance guide 261 may be disposed. The sheet conveyance guide 261 has a shape corresponding to the sheet conveyance direction through which the sheet fed from the first sheet conveyance unit is guided to the second sheet conveyance unit. In FIG. 3, the sheet conveyance guide 261 is curved so that the surface on the side where the sheet is conveyed is inward. In other words, the sheet conveyance guide 261 has an inwardly curved surface along which the sheet is conveyed. According to this shape of the sheet conveyance guide 261 in FIG. 3, the sheet conveyed from the second sheet conveyance unit is further conveyed in the upward direction. (Consequently, the sheet is conveyed forward along the shape of the sheet conveyance guide 261 while contacting the sheet conveyance guide 261.)

The sheet conveying device 200 is aware of (or recognizes) whether the sheet is conveyed correctly, based on the detection results detected by the first conveyance sensor 262 and the second conveyance sensor 263. Further, the sheet conveying device 200 determines respective start-stop timings of the sheet feed motor 252 and the sheet conveyance motor 272, based on the detection results (the detection timings) of the first conveyance sensor 262 and the second conveyance sensor 263.

In a comparative sheet conveying device (e.g., a known sheet conveying device), in a case of deterioration of sheet conveyance members such as the sheet feed roller 251 and the sheet separation roller 255 composing the first sheet conveyance unit and the sheet conveyance roller 271 and the sheet conveyance motor 272 composing the second sheet conveyance unit, the speed of sheet conveyance is reduced. By focusing on this fact, deterioration of such sheet conveyance members has been determined by index based on an "amount of movement of sheet per unit time", in other words, based on a "speed of sheet conveyance".

As such sheet conveyance members deteriorate, the coefficient of friction of the contact surface to the sheet is reduced to generate slippage, and therefore the speed of sheet conveyance decreases. Consequently, the sheet detection timing of a sheet detector such as the first conveyance sensor 262 delays. The comparative sheet conveying device detects the decrease of speed of sheet conveyance based on this delay, and determines that the sheet conveyance members have deteriorated. Here, the following equation, Equation 1, indicates the relation of a time "tpf" from the start of timing measurement (i.e., reference timing) to detection of the sheet by the sheet detector and a sheet speed (of sheet conveyance) "a*Vpf".

Equation 1.

$$t_{pf} = \frac{L_{typ}}{a \cdot V_{pf}} = \frac{L_{typ}}{V_{pf}} \cdot \frac{1}{a}, \qquad \text{Equation 1}$$

where "Ltyp" represents a length of sheet conveyance passage between the sheet feed roller and the sheet conveyance roller (the nominal distance or the maximum distance), "Vpf" represents a speed of the sheet feed roller and the sheet conveyance roller to feed out a sheet (the speed when the sheet feed roller and the sheet conveyance roller does not slip with respect to the sheet), and "a" represents a coefficient within a range from 0 to 1 (the coefficient that corrects "Vpf" in consideration of slippage between the sheet feed roller and the sheet).

In a case in which no slippage is generated between a sheet conveyance member and the sheet, "a" equals to 1 (i.e., a=1). By contrast, in a case in which the sheet conveyance member has deteriorated (in other words, the coefficient of friction of the sheet conveyance member has decreased) and slippage is generated between the sheet conveyance member and the sheet, "a" is smaller than 1 (i.e., a<1). As can be seen clearly from Equation 1, the time "tpf" is inversely proportional to "a" (i.e., $0 \leq a \leq 1$, where "a" has an allowable lower limit in an actual machine).

For example, it may be considered that the reference timing of the time "tpf" is a timing that the sheet has been detected by the first conveyance sensor 262 and that the time "tpf" is from the reference timing to a timing at which the sheet has been detected by the second conveyance sensor 263. It is to be noted that Equation 1 is a relational equation in a case in which the first conveyance sensor 262 is located at the same position as the shaft of the sheet feed roller 251 and the second conveyance sensor 263 is located at the same position as the shaft of the sheet conveyance roller 271.

However, with this method, the amount of change is small particularly at the initial stage of deterioration of the sheet conveyance member, and therefore it has been difficult to obtain sufficient accuracy.

In order to address this inconvenience, the sheet conveying device 200 in the present embodiment has been provided to determine a sheet conveyance state precisely and determine deterioration of the sheet conveyance member accurately, even when the amount of change is small, for example, at the initial stage of deterioration of the sheet conveyance member.

Figure 4A:
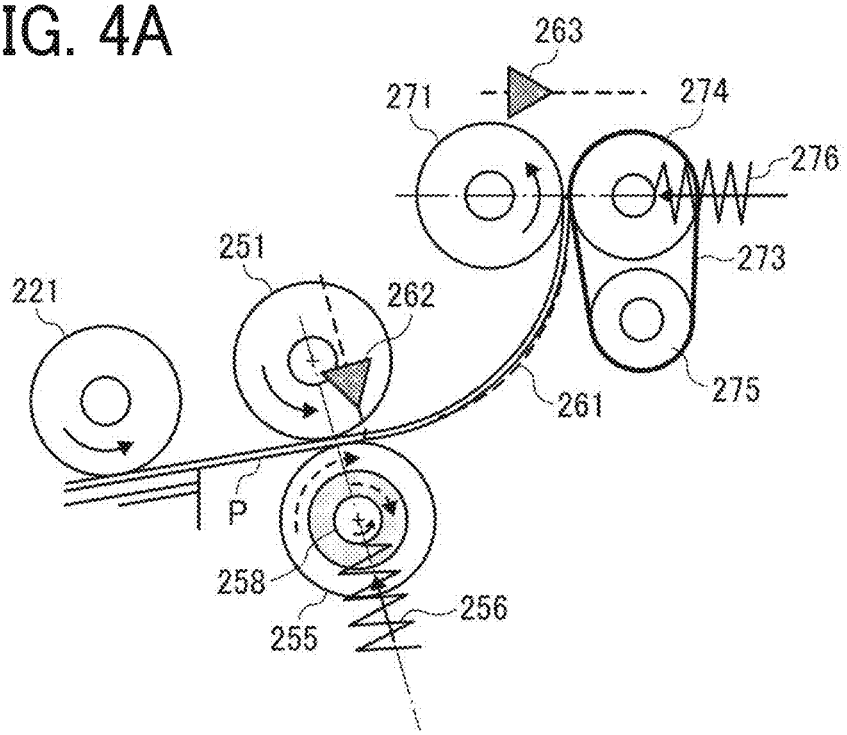
FIGS. 4A and 4B are diagrams illustrating states of a sheet to be conveyed by the sheet conveying device according to the present embodiment of this disclosure.
Figure 4B:
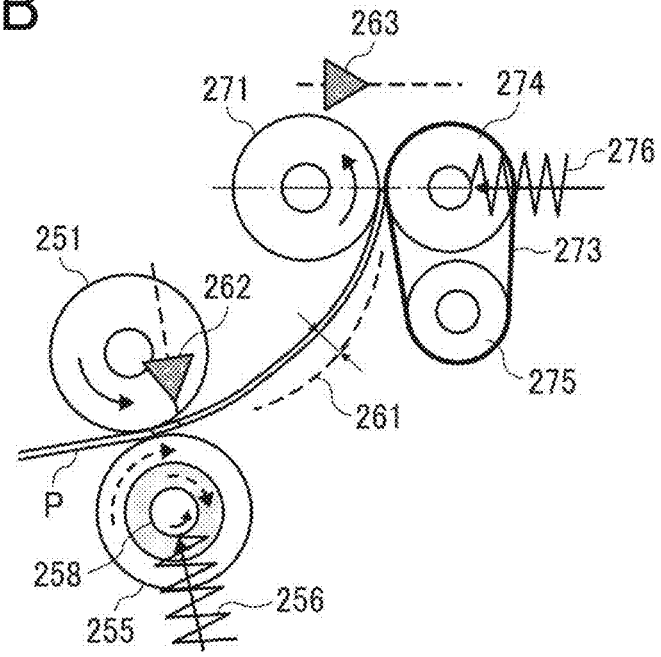

FIGS. 4A and 4B are diagrams illustrating states of a sheet to be conveyed by the sheet conveying device 200 according to the present embodiment of this disclosure.

In the present embodiment, in a case of deterioration of a sheet conveyance member, the coefficient of friction of the sheet conveyance member with the sheet is decreased to generate slippage. By focusing on this phenomenon that is different from the above-described fact of the comparative sheet conveying device, a characteristic amount (index) is proposed to have a larger amount of change and to determine deterioration of the sheet conveyance member more accurately when compared with the comparative sheet conveying device. The phenomenon that is focused on is that "sagging of sheet" that has been caused between the first sheet conveyance unit and the second sheet conveyance unit is eliminated by pulling the sheet by the sheet conveyance roller 271. The time until elimination of this "sagging of sheet" is defined as the characteristic amount (index).

In many cases, there is a gap (or gaps) in the sheet conveyance passage in the sheet conveying device 200, and the gap may be greater than the thickness of a sheet. In this case, the sagging of sheet may be generated. In particular, in a case in which the sheet conveyance passage is curved as illustrated in FIGS. 4A and 4B (in other words, the sheet conveyance guide 261 is curved), a difference of passage lengths is generated depending on that the sheet moves along a long path at the curve in the sheet conveyance passage or that the sheet moves in a shortest distance in the sheet conveyance passage. As a result, the difference corresponds to the amount of sagging of the sheet. For example, a sheet having a small repulsive force while being bent is fed from the nip region of the sheet feed roller 251, then the sheet is moved forward along the curve in the sheet conveyance passage in a state in which the sheet is also curved. Then, the sheet reaches the nip region of the sheet conveyance roller 271. In other words, since the sheet moves along the large curve of the sheet conveyance passage, the sheet sags.

The sheet conveying device illustrated in FIGS. 4A and 4B has a mechanism (including the sheet separation roller 255 that is disposed opposite the sheet feed roller 251) to separate sheets one by one. In the sheet conveying device illustrated in FIGS. 4A and 4B, due to the return force of the sheet separation roller 255, the actual speed of a sheet fed from the nip region of the sheet feed roller 251 may be slower than the actual speed of the sheet fed from the nip region of the sheet conveyance roller 271 that is set to the same feed speed as the sheet feed roller 251. Consequently, as the coefficient of friction of the sheet feed roller 251 decreases, the speed of the sheet becomes slower than the actual speed of the sheet fed from the nip region of the sheet conveyance roller 271. If the speed of the sheet is reduced, in a case in which the sheet has reached the sheet conveyance roller 271, the sheet is pulled by the sheet conveyance roller 271. If the sheet has been sagged, the sheet is pulled by the sheet conveyance roller 271 to eliminate the sagging of the sheet. The states the sagging of the sheet is eliminated are illustrated in FIGS. 4A to 4B.

Since the "sagging of sheet" is eliminated by pulling the sheet by the sheet conveyance roller 271, the driving force of the sheet conveyance roller 271 is transmitted to the sheet feed motor 252 via the sheet after the sagging of the sheet is eliminated. The load of the sheet conveyance motor 272 increases and the load of the sheet feed motor 252 decreases. The change of the load of each motor (i.e., the sheet conveyance motor 272 and the sheet feed motor 252) is recognized from the torque change of each motor. The time until elimination of the sagging of sheet is recognized from the timing at which the change of the torque occurs.

The time until elimination of the sagging of sheet is proportional to the "sagging amount" and is inversely proportional to the "difference of the actual speed of a sheet that is fed from the nip region of the sheet conveyance roller 271 and the actual speed of a sheet that is fed from the nip region of the sheet feed roller 251 (the speed difference)." A "time until elimination of the sagging of a sheet: t'" is expressed by Equation 2. If it is difficult to calculate an accurate time of the "time until elimination of the sagging of a sheet: t'", an index close to the value of "t" (for example, a time "tf" in Equation 2) may be used instead. (The time "tf" is explained below, with reference o FIG. 7.)

Equation 2.

$$t_f \approx t' = \frac{L_{typ} - L_{short}}{V_{pf} \cdot (1-a)} = \frac{\Delta L}{V_{pf} \cdot (1-a)} = -\frac{\Delta L}{V_{pf}} \cdot \frac{1}{a-1}, \qquad \text{Equation 2}$$

where ΔL represents an amount of sagging of a sheet in a sheet conveyance passage between the sheet feed roller and the sheet conveyance roller.

Figure 5:
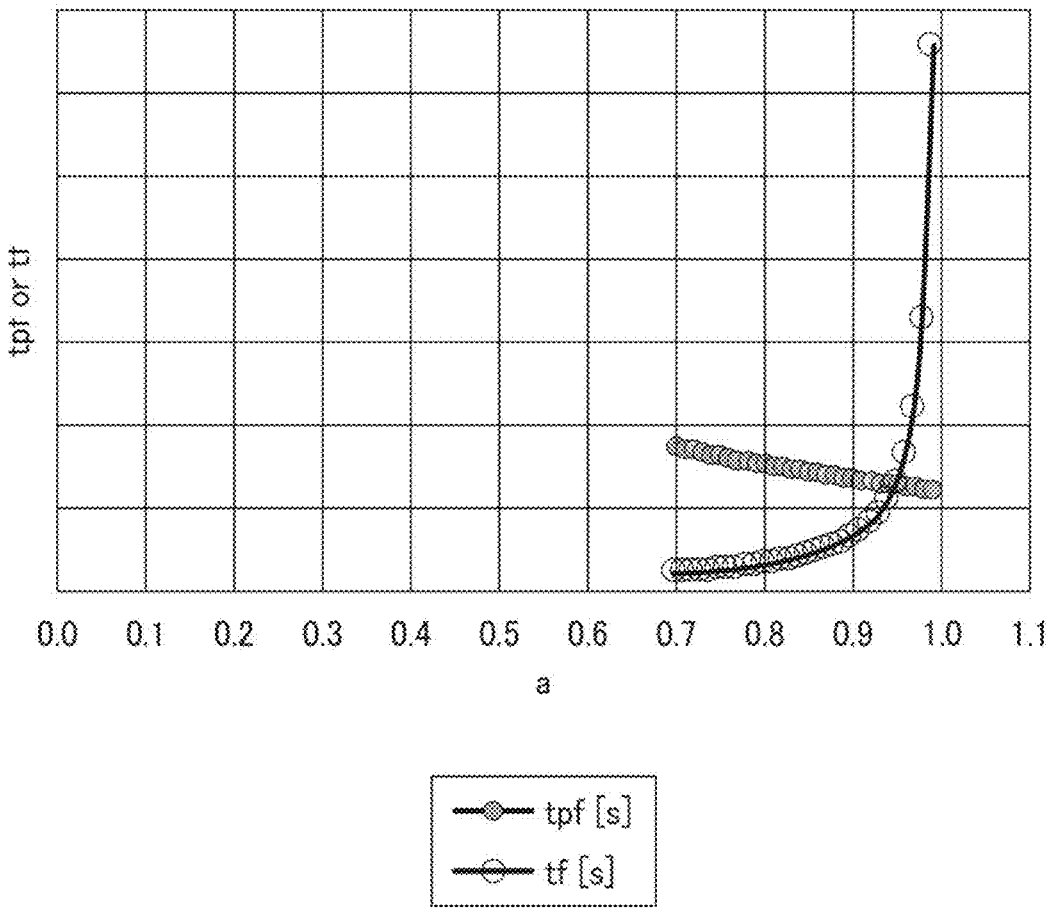
FIG. 5 is a diagram illustrating a relation of a time "tpf" (Equation 1) and a time "tf" (Equation 2)

FIG. 5 is a diagram illustrating the relation of the time "tpf" (Equation 1) and the time "tf" (Equation 2). FIG. 5 is illustrated with an appropriate value to each parameter of Equation 1 and an appropriate value to each parameter of Equation 2. The time "tpf" (Equation 1) is for a comparative example and the time "tf" (Equation 2) is for the present embodiment.

By considering the allowable range of "a" in an actual device, the allowable range is expressed as "0.7≤a≤0.99". It is to be noted that, when the speed difference is relatively small, the sheet passes through the nip region of the sheet feed roller 251 before the sagging of the sheet is eliminated (or the sheet feed motor 252 is stopped as an action of the device), and therefore the time "t'" or the time "tf" are considered not to be calculated. However, such a state in which the time "t'" or the time "tf" cannot be calculated is used to determine the deterioration of sheet conveyance members.

While the index used in the comparative example is inversely proportional to "the speed for feeding out the sheet by the sheet conveyance member (the sheet feed roller 251) and another sheet conveyance member considering slippage of the sheet", the index to be proposed in the present example is inversely proportional to "the difference of the speed for feeding out the sheet" between a first sheet conveyance member (i.e., the sheet feed roller 251) and a second sheet conveyance member (i.e., the sheet conveyance roller 271) disposed downstream from the first sheet conveyance member in the sheet conveyance direction. Accordingly, with the setting of appropriate values to respective parameters, the ratio of change of the index to be proposed in the present example increases up to a predetermined amount of slippage, and therefore the index is more accurate.

Figure 6A:
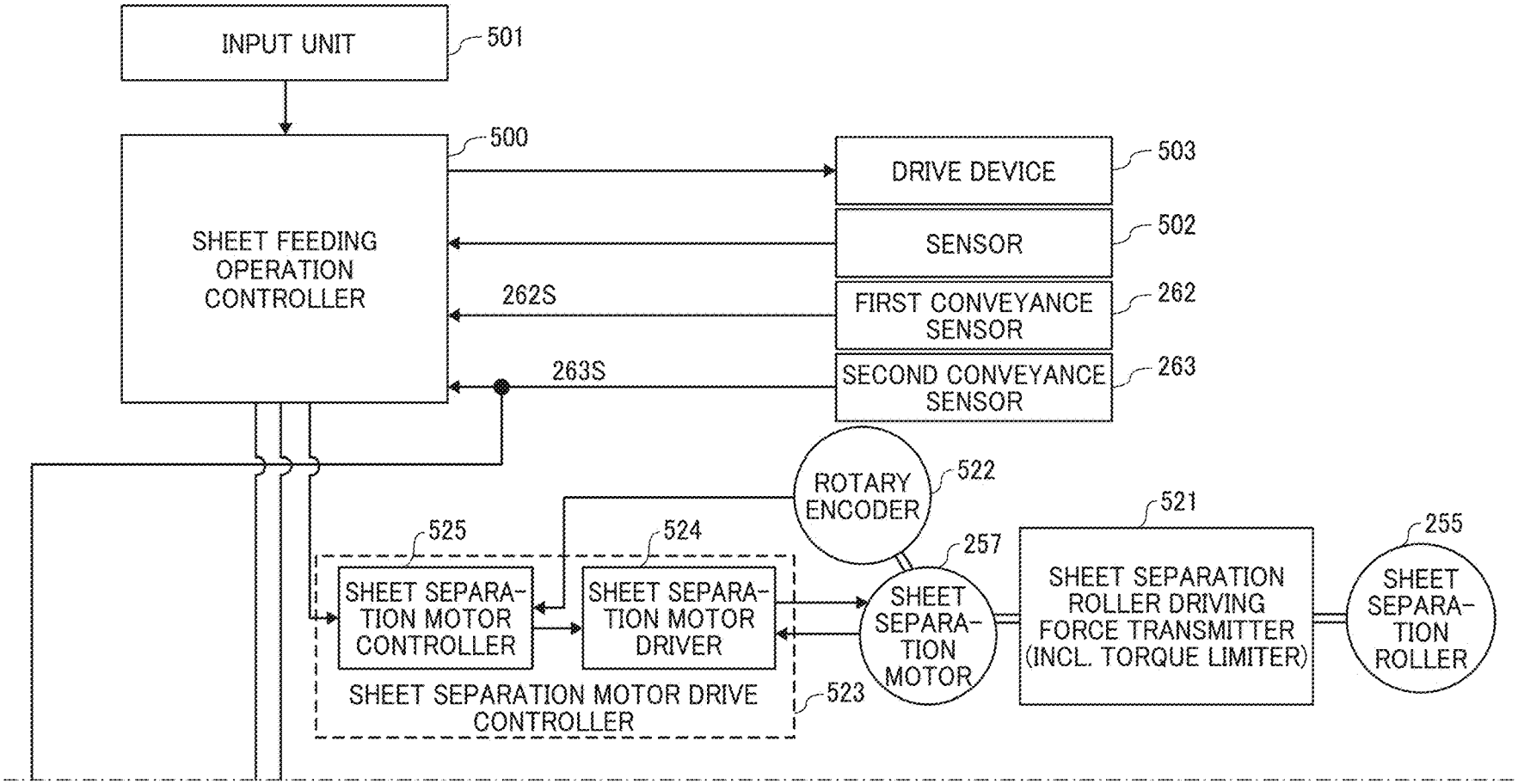
FIGS. 6A and 6B is a control block diagram illustrating the sheet conveying device according to the present embodiment.
Figure 6B:
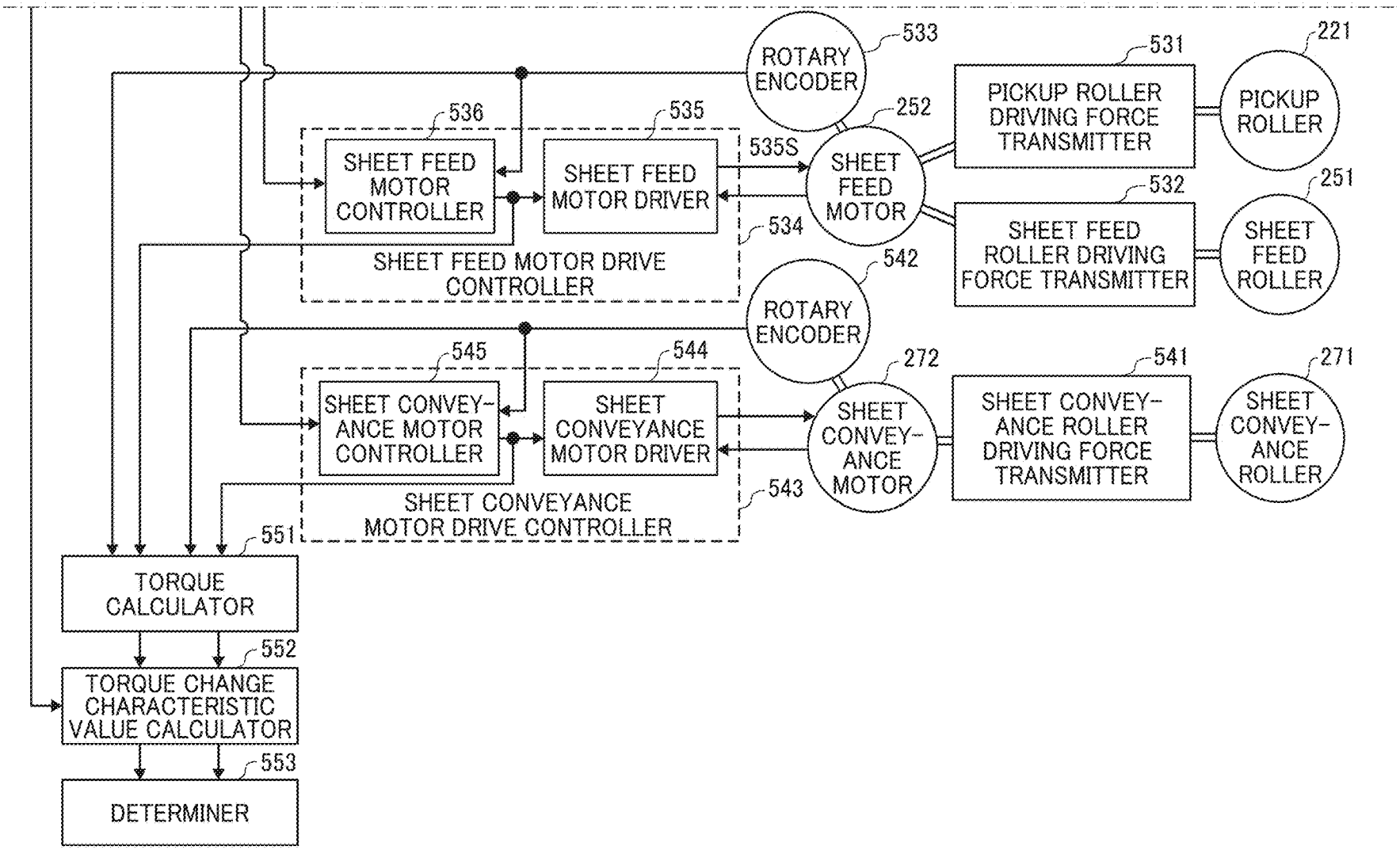

FIG. 6 is a block diagram illustrating a control system of the sheet conveying device 200 according to the present embodiment. FIG. 6 is divided into two drawing sheets of FIGS. 6A and 6B to comply with the guide for preparation of patent drawings.

The sheet conveying device 200 includes an input unit 501, a sheet feeding operation controller 500, a sensor 502, and a drive device 503. The input unit 501 receives inputs (commands) such as the number of sheets to be supplied by a user and a sheet feeding operation start command. The sheet feeding operation controller 500 controls operations of the sheet conveying device 200 based on data that was input to the input unit 501. The sensor 502 outputs various detection information to the sheet feeding operation controller 500. The drive device 503 drives various members and components based on respective output signals from the sheet feeding operation controller 500.

The sheet feeding operation controller 500 acquires information from the sensor 502, such as information of presence and absence of sheets on the sheet loading tray 44 and information of size detection, and causes the drive device 503 to lift the sheet lifting plate 241 to a predetermined height (a predetermined position). When the number of sheets turns to zero (0), in other words, when no sheet is detected on the sheet loading tray 44, the sheet feeding operation controller 500 causes the drive device 503 to lower the sheet lifting plate 241. When the sheet loading trays 44 is pulled out from the sheet conveying device 200, the sheet feeding operation controller 500 initializes the driving of the sheet lifting plate 241. In other words, the driving state of the sheet lifting plate 241 is changed to an initial state.

The sheet feeding operation controller 500 determines the sheet conveyance speed according to the sheet type set (input) via the input unit 501, acquires detection information 262S (i.e., an output signal 262S) from the first conveyance sensor 262 and detection information 263S (i.e., an output signal 263S) from the second conveyance sensor 263, and drives the sheet separation motor 257, the sheet feed motor 252, and the sheet conveyance motor 272.

The sheet conveying device 200 further includes a sheet feed motor drive controller 534, a rotary encoder 533, a pickup roller driving force transmitter 531, and a sheet feed roller driving force transmitter 532. The sheet feed motor drive controller 534 drives and controls the sheet feed motor 252 based on an output signal from the sheet feeding operation controller 500. The rotary encoder 533 detects and outputs the rotation speed of the sheet feed motor 252. The pickup roller driving force transmitter 531 transmits the driving force of the sheet feed motor 252 to the pickup roller 221. The sheet feed roller driving force transmitter 532 transmits the driving force of the sheet feed motor 252 to the sheet feed roller 251. The pickup roller driving force transmitter 531 includes a timing belt 253.

The sheet feed motor drive controller 534 includes a sheet feed motor controller 536 and a sheet feed motor driver 535. The sheet feed motor controller 536 performs digital control with a microcomputer such that a signal is input from the rotary encoder 533 to rotate the sheet feed motor 252 at a target speed indicated (received) from the sheet feeding operation controller 500. Then, the sheet feed motor controller 536 outputs, to the sheet feed motor driver 535, a signal corresponding to a voltage to be applied to the sheet feed motor 252 (e.g., a PWM signal) and a signal indicating a rotational direction of the sheet feed motor 252. The sheet feed motor driver 535 outputs a sheet feed motor drive signal 535S to the sheet feed motor 252. The sheet feed motor 252 outputs a Hall element signal to the sheet feed motor driver 535.

The sheet conveying device 200 further includes a sheet separation motor drive controller 523, a rotary encoder 522, and a sheet separation roller driving force transmitter 521. The sheet separation motor drive controller 523 drives and controls the sheet separation motor 257 based on an output signal from the sheet feeding operation controller 500. The rotary encoder 522 detects and outputs the rotation speed of the sheet separation motor 257. The sheet separation roller driving force transmitter 521 transmits the driving force of the sheet separation motor 257 to the sheet separation roller 255. The sheet separation roller driving force transmitter 521 includes a torque limiter 258.

The sheet separation motor drive controller 523 includes a sheet separation motor controller 525 and a sheet separation motor driver 524. The sheet separation motor controller 525 performs digital control with a microcomputer such that a signal is input from the rotary encoder 522 to rotate the sheet separation motor 257 at a target speed indicated (received) from the sheet feeding operation controller 500. Then, the sheet separation motor controller 525 outputs, to the sheet separation motor driver 524, a signal corresponding to a voltage to be applied to the sheet separation motor 257 (e.g., a PWM signal) and a signal indicating a rotational direction the sheet separation motor 257. The sheet separation motor 257 outputs a Hall element signal to the sheet separation motor driver 524. The sheet separation motor driver 524 outputs a drive signal to the sheet separation motor 257.

The sheet conveying device 200 further includes a sheet conveyance motor drive controller 543, a rotary encoder 542, and a sheet conveyance roller driving force transmitter 541. The sheet conveyance motor drive controller 543 drives and controls the sheet conveyance motor 272 based on an output signal from the sheet feeding operation controller 500. The rotary encoder 542 detects and outputs the rotation speed of the sheet conveyance motor 272. The sheet conveyance roller driving force transmitter 541 transmits the driving force of the sheet conveyance motor 272 to the sheet conveyance roller 271.

The sheet conveyance motor drive controller 543 includes a sheet conveyance motor controller 545 and a sheet conveyance motor driver 544. The sheet conveyance motor controller 545 performs digital control with a microcomputer such that a signal is input from the rotary encoder 542 to rotate the sheet conveyance motor 272 at a target speed indicated (received) from the sheet feeding operation controller 500. Then, the sheet conveyance motor controller 545 outputs, to the sheet conveyance motor driver 544, a signal corresponding to a voltage to be applied to the sheet conveyance motor 272 (e.g., a PWM signal) and a signal indicating a rotational direction the sheet conveyance motor 272. The sheet conveyance motor 272 outputs a Hall element signal to the sheet conveyance motor driver 544. The sheet conveyance motor driver 544 outputs a drive signal to the sheet conveyance motor 272.

The sheet feed motor 252, the sheet separation motor 257, and the sheet conveyance motor 272 include a motor such as a DC brushless motor.

The rotary encoders 522, 533, and 542, for example, monitor respective rotation speeds of the motor shafts of the sheet feed motor 252, the sheet separation motor 257, and the sheet conveyance motor 272, and output respective signals (i.e., respective rectangular wave signals) having periods corresponding to the rotational speeds.

The sheet feed motor controller 536, the sheet separation motor controller 525, and the sheet conveyance motor controller 545 perform, for example, double loop control in which the speed control is performed in the miner loop and the position control is performed n the major loop. The control method is selected from the P control, the PI control, and the PID control.

The sheet feeding operation controller 500 acquires detection information from the first conveyance sensor 262 and the second conveyance sensor 263, determines whether the operation is in a normal state or in an abnormal state, and informs a user of the state of the operation (e.g., a state in which a sheet is not fed from the sheet loading tray 44, a state in which a sheet is jammed).

The torque calculator 551 acquires a signal corresponding to the rotation speed of the sheet feed motor 252 to be output from the rotary encoder 533, a signal corresponding to an application voltage of the sheet feed motor 252 to be output from the sheet feed motor controller 536 to the sheet feed motor driver 535, and a signal indicating the rotational direction of the sheet feed motor 252, Based on the signals, the torque calculator 551 calculates the torque of the sheet feed motor 252.

The torque calculator 551 acquires a signal corresponding to the rotation speed of the sheet conveyance motor 272 to be output from the rotary encoder 542, a signal corresponding to an application voltage of the sheet conveyance motor 272 to be output from the sheet conveyance motor controller 545 to the sheet conveyance motor driver 544, and a signal indicating the rotational direction of the sheet conveyance motor 272. Based on the signals, the torque calculator 551 calculates the torque of the sheet conveyance motor 272.

Instead of acquiring the signal indicating the rotational direction of each motor, the torque calculator 551 may acquire information of the rotational direction of each motor from the plus and minus sign of motor application voltage information.

The torque calculator 551 uses a disturbance observer for calculating the torque. The torque calculator 551 performs with a microcomputer. The torque calculator 551 may share the microcomputer with the above-described controllers.

The torque change characteristic value calculator 552 receives data of the torque calculated by the torque calculator 551. In other words, torque data calculated by the torque calculator 551 is input to the torque change characteristic value calculator 552. Then, the torque change characteristic value calculator 552 calculates the characteristic amount (index) of the torque change before and after the sheet fed out from the first sheet conveyance unit reaches the second sheet conveyance unit. The calculation method will be described below with reference to FIGS. 7 and 8.

The torque change characteristic value calculator 552 performs with a microcomputer. The torque change characteristic value calculator 552 may share the microcomputer with the above-described controllers or with the torque calculator 551.

The determiner 553 that functions as part of circuitry determines a sheet conveyance state based on the characteristic amount (index) calculated by the torque change characteristic value calculator 552. In other words, the first sheet conveyance unit determines the sheet conveyance state of a sheet based on at least one of torque of the sheet feed motor 252 of the first sheet conveyance unit or torque of the sheet conveyance motor 272 of the second sheet conveyance unit.

The determiner 553 compares the characteristic amount calculated by the torque change characteristic value calculator 552 with a predetermined threshold value, and determines whether sheet conveyance is normal or not (i.e., whether the sheet conveyance member has deteriorated or not). Based on the detection result of the determiner 553, the sheet conveying device 200 may perform the feedback control (for example, the strength of sheet conveyance is increased), issue an alert (for example, a command to replace the sheet conveyance member), or present (an alert) to a service engineer.

The determination result of the determiner 553 may be digitized to display on a numerical display or a liquid crystal display. In a case in which the sheet conveying device 200 includes a display unit, for example, in a user interface unit, the display unit may be shared.

It is to be noted that a motor to drive the torque calculator 551, the torque change characteristic value calculator 552, and the determiner 553 may be either or both of the sheet feed motor 252 and the sheet conveyance motor 272. Alternatively, by considering the number of loads (i.e., rollers) driven by each of the sheet feed motor 252 and the sheet conveyance motor 272, one motor having the characteristic amount (index) of the torque change that is greater and more recognizable than the other motor may be selected from the sheet feed motor 252 and the sheet conveyance motor 272. In other words, the determiner 553 determines the sheet conveyance state of the sheet, based on torque of one motor having a greater amount of torque change between the sheet feed motor 252 of the first sheet conveyance unit and the sheet conveyance motor 272 of the second sheet conveyance unit.

Figure 7:
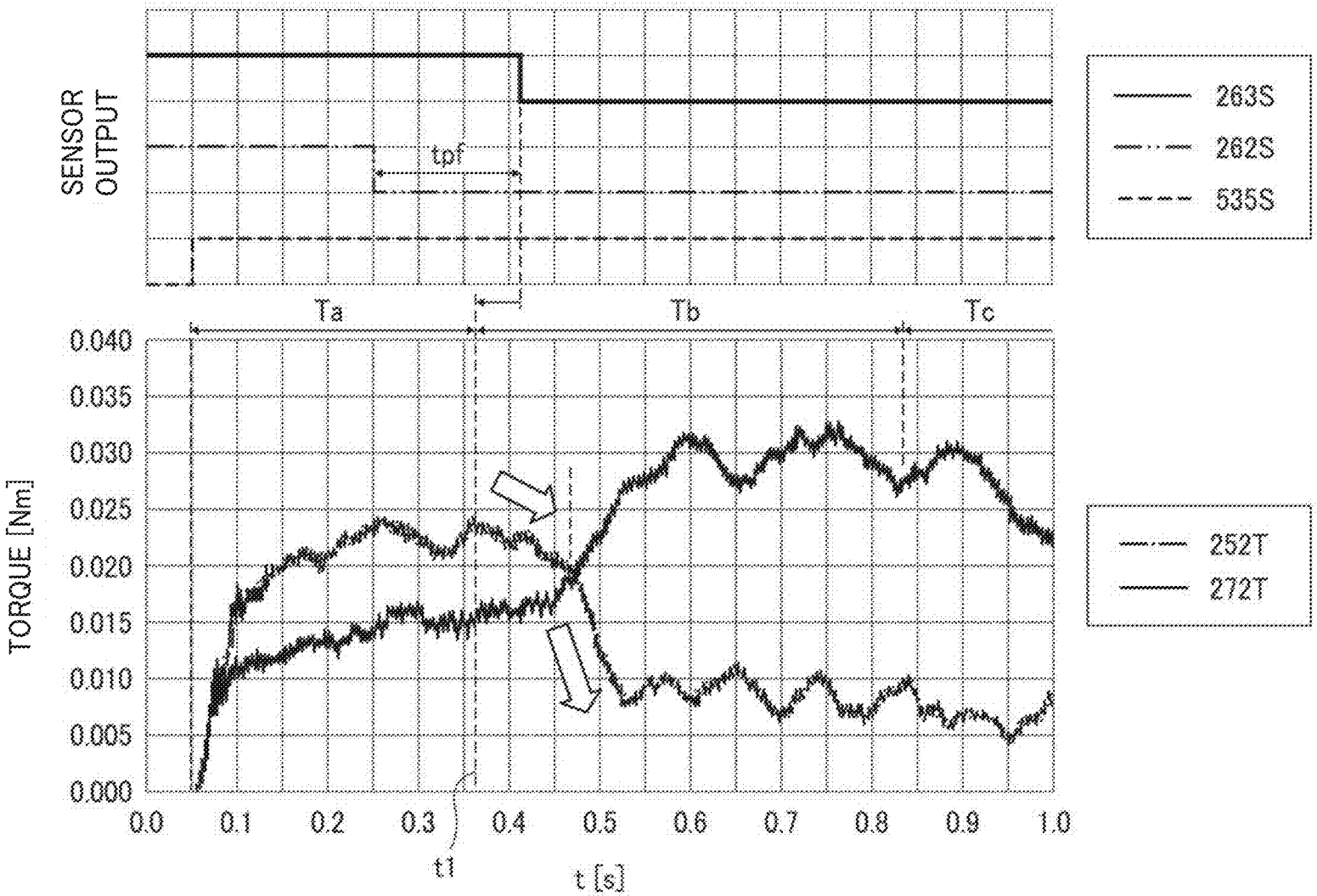
FIG. 7 is a timing chart of the sheet conveying device according to the present embodiment.

FIG. 7 is a timing chart of the sheet conveying device 200 according to the present embodiment. The timing chart of FIG. 7 indicates the output signal 262S of the first conveyance sensor 262, the output signal 263S of the second conveyance sensor 263, torque 252T of the sheet feed motor 252, and torque 272T of the sheet conveyance motor 272.

First, the sheet conveying device 200 turns on the sheet feed motor drive signal 535S to activate the sheet feed motor 252. Ideally, the sheet separation motor 257 and the sheet conveyance motor 272 have been activated to the steady rotation before the sheet reaches the sheet separation roller 255 and the sheet conveyance roller 271, respectively. In the example in FIG. 7, however, the sheet separation motor 257 and the sheet conveyance motor 272 are activated simultaneously with the sheet feed motor 252. (It is to be noted that the torque waveform of the sheet separation motor 257 is not included in FIG. 7.)

When the leading end of the sheet reaches the detection position of the first conveyance sensor 262, the output signal 262S of the first conveyance sensor 262 changes. (In FIG. 7, the LOW level of the waveform of the output signal 262S indicates presence of sheet.) Then, when the sheet is further conveyed and the leading end of the sheet reaches the detection position of the second conveyance sensor 263, the output signal 263S of the second conveyance sensor 263 changes. (In FIG. 7, the LOW level of the waveform of the output signal 263S indicates presence of sheet.)

In a case in which the first conveyance sensor 262 is disposed downstream from the sheet feed roller 251 and the second conveyance sensor 263 is disposed downstream from the sheet conveyance roller 271 in the sheet conveyance direction, respective timings of detection of the sheet by the first conveyance sensor 262 and the second conveyance sensor 263 are immediately after respective arrivals of the sheet to the sheet feed roller 251 and the sheet conveyance roller 271. In other words, the first conveyance sensor 262 and the second conveyance sensor 263 do not detect the sheet at the same time the sheet arrives the sheet feed roller 251 and the sheet conveyance roller 271, respectively.

For example, the timing at which the sheet reaches the sheet conveyance roller 271 is slightly earlier than the timing at which the output signal 263S of the second conveyance sensor 263 changes (in other words, the signal changes from the HIGH level to the LOW level). (In FIG. 7, the timing at which the sheet reaches the sheet conveyance roller 271 is indicated as a timing t1.) The timing difference depends on the sheet conveyance speed and the distance from the sheet conveyance roller 271 to the second conveyance sensor 263.

The torque 252T of the sheet feed motor 252 and the torque 272T of the sheet conveyance motor 272 are recognized by the torque calculator 551.

The torque 252T of the sheet feed motor 252 is high from a timing immediately after activation of the sheet feed motor 252 through a section in which the sheet is conveyed by the driving force of the sheet feed motor 252 alone. Immediately after the sheet reaches the sheet conveyance motor 272, the torque decreases gradually then rapidly, and then settles at a low level.

The torque 272T of the sheet conveyance motor 272 has transitioned to a high level after the sheet reaches the sheet conveyance motor 272. By contrast, the torque change immediately after the sheet reaches the sheet conveyance motor 272 is a moderate increase. Thereafter, the torque 272T of the sheet conveyance motor 272 increases rapidly, then settles in a high level (except the latter half of the waveform that decreases by the influence of a motor subsequent to the sheet conveyance motor 272).

In FIG. 7, reference letter "Ta" represents a period of sheet conveyance by the sheet feed motor 252 alone, reference letter "Tb" represents a period of sheet conveyance by the sheet feed motor 252 and the sheet conveyance motor 272, and reference letter "Tc" represents a period of sheet conveyance additionally by the subsequent motor.

As described above, in the torque waveforms, there is a period in which the torque gradually changes immediately after the sheet reaches the sheet conveyance motor 272. This phenomenon is caused due to "sagging" of the sheet in the sheet conveyance passage between the sheet feed roller 251 and the sheet conveyance roller 271. A letter "t'" described in Equation 2 represents the length of the period in which the torque gradually changes immediately after the sheet reaches the sheet conveyance motor 272.

In the present embodiment, in order to determine deterioration of sheet conveyance members more accurately than sheet conveyance members of the comparative sheet conveying device, an index "t'" is proposed to be inversely proportional to a difference (speed B−speed A) of the speed of a sheet that is fed by the sheet feed roller 251 (speed A) and the speed of a sheet that is fed by the sheet conveyance roller 271 (speed B). As described above, the index "t'" is recognized by the torque change of the sheet feed motor 252 and the torque change of the sheet conveyance motor 272.

Figure 8:
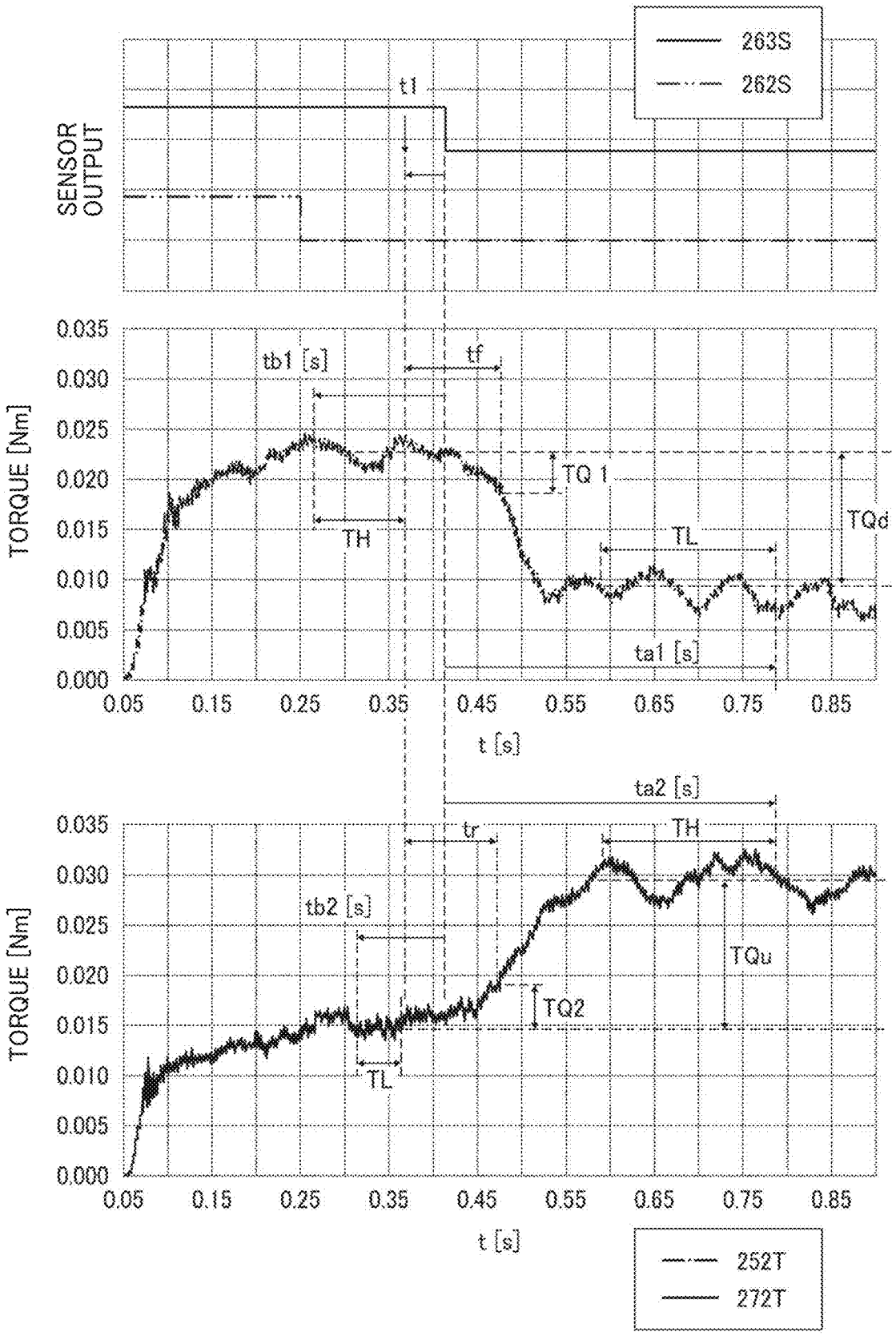
FIG. 8 is a diagram illustrating processing performed by a torque change characteristic value calculator according to the present embodiment.

FIG. 8 is a diagram illustrating processing performed by the torque change characteristic value calculator 552 according to the present embodiment.

In the torque waveform of the torque 252T of the sheet feed motor 252 and the torque waveform of the torque 272T of the sheet conveyance motor 272, the torque change characteristic value calculator 552 takes a period in which the torque gradually changes immediately after the sheet has reached the sheet conveyance motor 272 (i.e., the time "e" explained with Equation 2) as the characteristic amount of the torque change.

However, if it is difficult to calculate the time "e" from the torque waveform, for example, when it is difficult to accurately calculate an inflection point at which the torque waveform changes from a moderate change to a rapid change, an index "tf" or an index "tr", which are close to the time "t'", may be used as the characteristic amount (index) of the torque change. In FIG. 8, the definitions of the index "tf" and the index "tr" (the calculation method based on torque data) are indicated.

The torque change characteristic value calculator 552 uses a threshold value to the amount of torque instead of the "inflection point" in which the torque waveform changes from a moderate change to a rapid change. With the threshold value, when the torque has transited form the moderate change to the rapid change, the torque change characteristic value calculator 552 recognizes the timing that crosses the threshold value.

Then, the time from the timing when the sheet reaches the sheet conveyance motor 272 to the timing when the torque waveform crosses the threshold value is used as an index.

In a case in which the second conveyance sensor 263 is not disposed immediately below the sheet conveyance roller 271, the torque change characteristic value calculator 552 calculates a sheet speed based on the rotation speed and a target value of the sheet conveyance roller 271, the timing at which the sheet reaches the sheet conveyance motor 272 is estimated based on the sheet speed and a distance (a set value) from the sheet conveyance roller 271 to the second conveyance sensor 263 (i.e., the timing t1 indicated in FIG. 8).

The torque change characteristic value calculator 552 employs the index "tf" when using the torque waveform of the torque 252T of the sheet feed motor 252, and the index "tr" when using the torque waveform of the torque 272T of the sheet conveyance motor 272.

The torque change characteristic value calculator 552 first calculates the HIGH level and the LOW level of the torque waveform, and multiplies the difference of the HIGH level and the LOW level (in other words, decrease and increase) of the torque waveform by a predetermined ratio (that is greater than 0 and is less than 1). Then, the torque change characteristic value calculator 552 obtains the above-described threshold value by subtracting the obtained value from the HIGH level when the sheet feed motor 252 is used or adding the obtained value to the LOW level when the sheet conveyance motor 272 is used.

The torque change characteristic value calculator 552 sets the average value of a predetermined period TH by a time tb1 [s] before the timing at which the output signal 263S of the second conveyance sensor 263 changes, as the HIGH level of the torque 252T of the sheet feed motor 252. The time tb1 [s] starts after the timing at which the output signal 262S of the first conveyance sensor 262 changes or after the estimated timing at which the sheet enters the sheet feed roller 251. The predetermined period TH continues until an estimated timing t1 at which the sheet reaches the sheet conveyance motor 272.

The torque change characteristic value calculator 552 sets the average value of a predetermined period TL during which the torque level is stable after the rapid change of the torque has been finished, as the LOW level of the torque 252T of the sheet feed motor 252. The predetermined period TL continues until a time ta1 [s] after the timing at which the output signal 263S of the second conveyance sensor 263 changes.

The torque change characteristic value calculator 552 calculates a difference TQd between the HIGH level and the LOW level of the torque 252T of the sheet feed motor 252, and sets a threshold value TQ1 based on the difference TQd.

The torque change characteristic value calculator 552 calculates a period, which is the time "tf", from the estimated timing t1 at which the sheet reaches the sheet conveyance motor 272 to the timing at which the torque 252T of the sheet feed motor 252 crosses the threshold value TQ1.

Further, the torque change characteristic value calculator 552 sets an average value of the predetermined period TL by a time tb2 [s] before a timing at which the output signal 263S of the second conveyance sensor 263 changes, as the LOW level of the torque 272T of the sheet conveyance motor 272, or sets an average value of data within the predetermined time before and after the minimum value within the predetermined period TL, as the LOW level of the torque 272T of the sheet conveyance motor 272. The predetermined period TL continues to the estimated timing t1 at which the sheet reaches the sheet conveyance motor 272.

The torque change characteristic value calculator 552 sets the average value of the predetermined period TH during which the torque level is stable after the rapid change of the torque is finished, as the HIGH level of the torque 272T of the sheet conveyance motor 272. The predetermined period TH continues to a timing by a time ta2 [s] after a timing at which the output signal 263S of the second conveyance sensor 263 changes.

The torque change characteristic value calculator 552 calculates a difference TQu between the HIGH level and the LOW level of the torque 272T of the sheet conveyance motor 272, and sets a threshold value TQ2 based on the difference TQu.

The torque change characteristic value calculator 552 calculates the period "tr" from the estimated timing t1 at which the sheet reaches the sheet conveyance motor 272 to a timing at which the torque 272T of the sheet conveyance motor 272 crosses the threshold value TQ2.

The above-described configuration and functions, the threshold values TQ1 and TQ2 are set appropriately to reduce errors of the times "tf" and "tr" to the timing "t".

Figure 9:
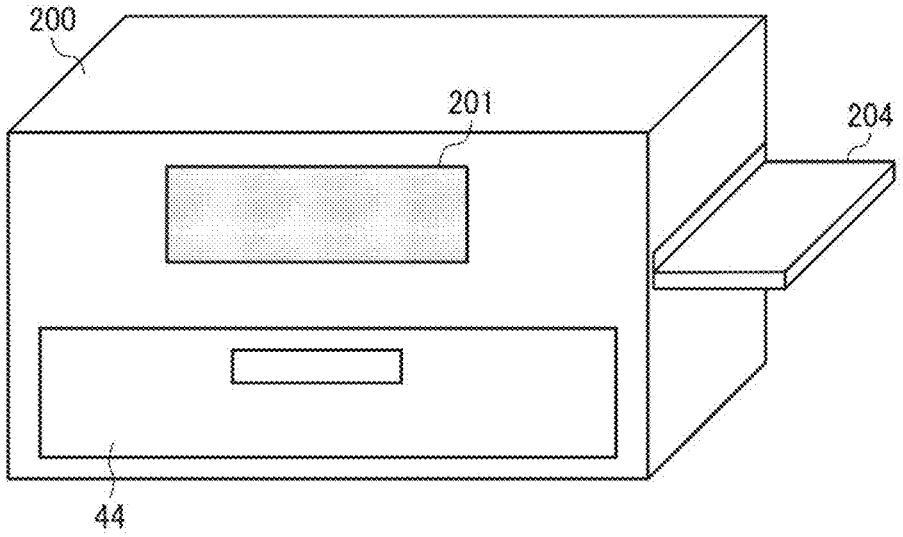
FIG. 9 is a diagram illustrating an example of displaying a determination result of a determiner according to the present embodiment.

FIG. 9 is a diagram illustrating an example of displaying a determination result of the determiner 553 according to the present embodiment.

The sheet conveying device 200 includes the sheet loading tray 44, a sheet ejection port tray 204, and a display 201. The sheet ejection port tray 204 ejects a sheet. The display 201 displays the determination result of the determiner 553.

The display 201 is a liquid crystal display and displays the sheet conveyance state determined by the determiner 553 in numerical form.

Figure 10:
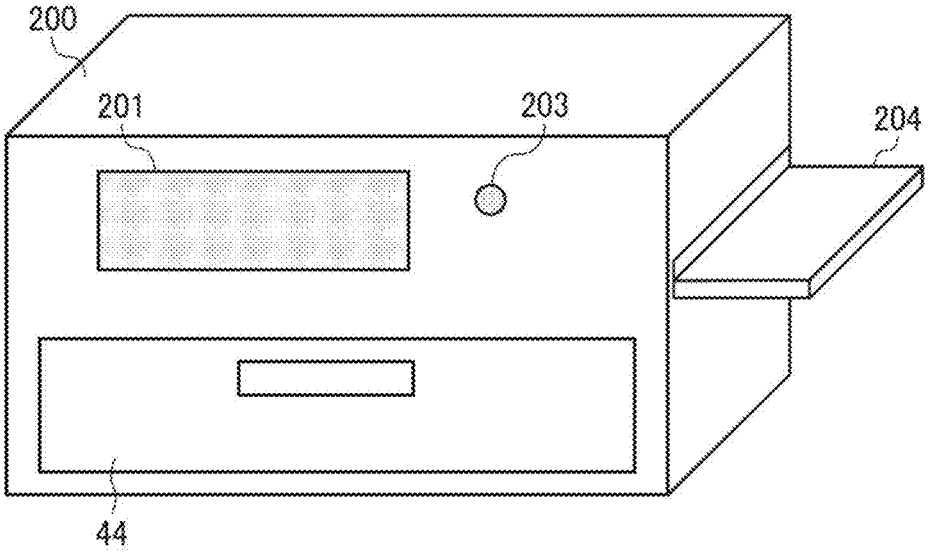
FIG. 10 is a diagram illustrating an example of reporting the determination result of the determiner according to the present embodiment.

FIG. 10 is a diagram illustrating an example of reporting the determination result of the determiner 553 according to the present embodiment.

In addition to the configuration illustrated in FIG. 9, the sheet conveying device 200 includes a warning unit 203 that informs the determination result of the determiner 553.

The warning unit 203 includes a light emitting diode (LED), and digitizes the sheet conveyance state determined by the determiner 553. When the digitized value reaches the "warning threshold", the warning unit 203 turns on (or blinks) the LED to notify that the digitized value has reached the warning threshold.

Figure 11A:
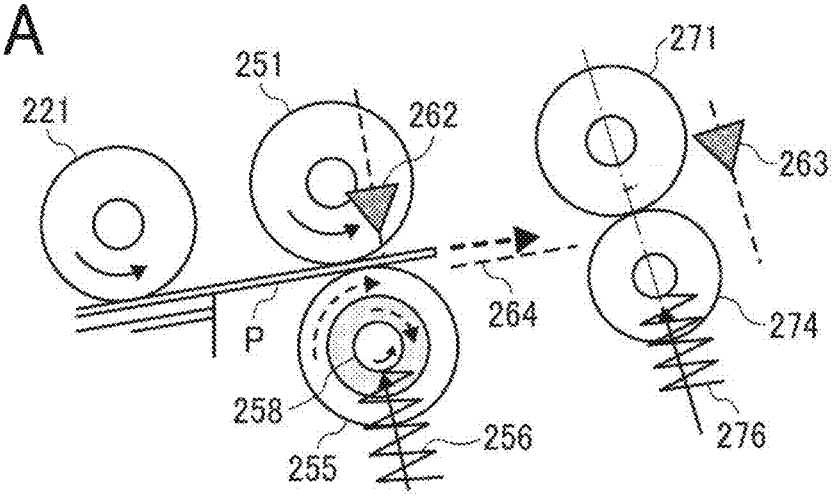
FIGS. 11A, 11B, and 11C are diagrams illustrating a variation of the sheet conveying device of FIGS. 3 and 4.
Figure 11B:
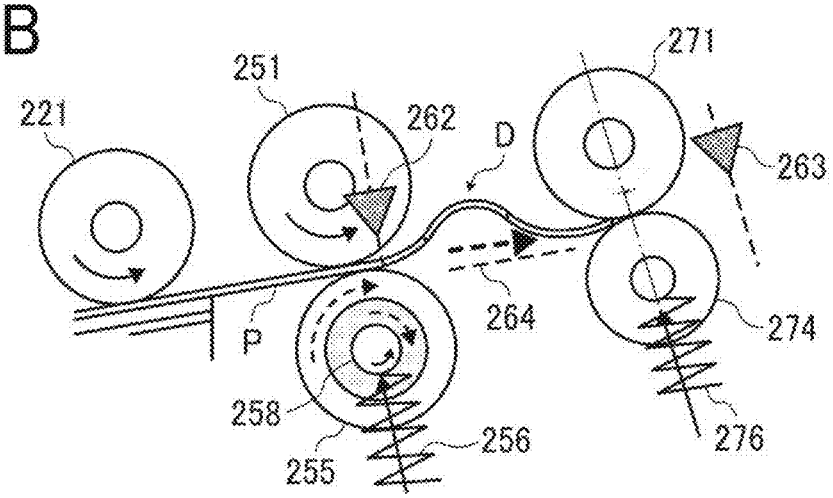
Figure 11C:
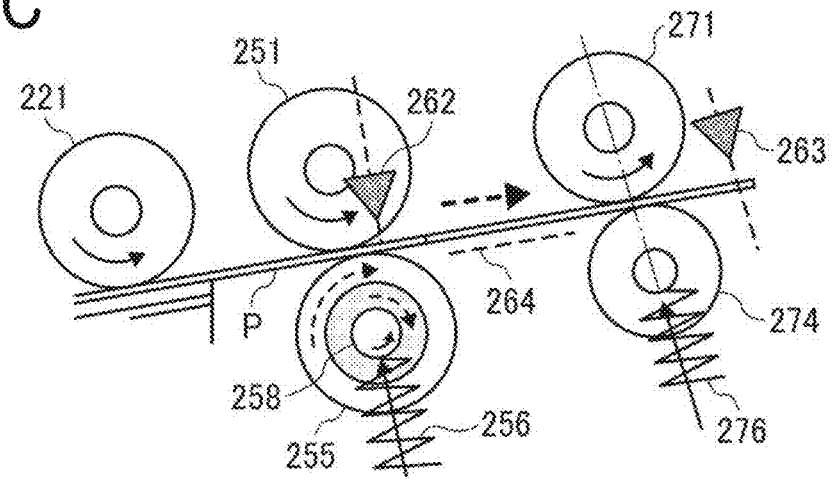

FIGS. 11A, 11B, and 11C are diagrams illustrating a variation of the configuration of the sheet conveying device 200 of FIGS. 3 and 4.

The sheet conveying device 200 of the variation of FIGS. 11A, 11B, and 11C includes a sheet conveyance guide 264 having a straight shape, instead of the sheet conveyance guide 261 having a curved shape as illustrated in FIGS. 3 and 4.

The sheet conveying device 200 of this variation controls the driving timing of the sheet conveyance roller 271 of the second sheet conveyance unit to cause sagging in the sheet.

As illustrated in FIG. 11B, the sheet conveying device 200 of this variation generates "sagging D" in the sheet by rotating the sheet feed roller 251 and abutting the sheet against the sheet conveyance roller 271 that is stopped. (A sheet sagging generator.)

Thereafter, as illustrated in FIG. 11C, the sheet conveying device 200 of this variation rotates the sheet conveyance roller 271 to eliminate the "sagging D" of the sheet.

In this variation, as in the embodiment described above with reference to FIGS. 3 to 10, the time until the "sagging D of the sheet" is eliminated may be used as the characteristic amount (index).

Figure 12:
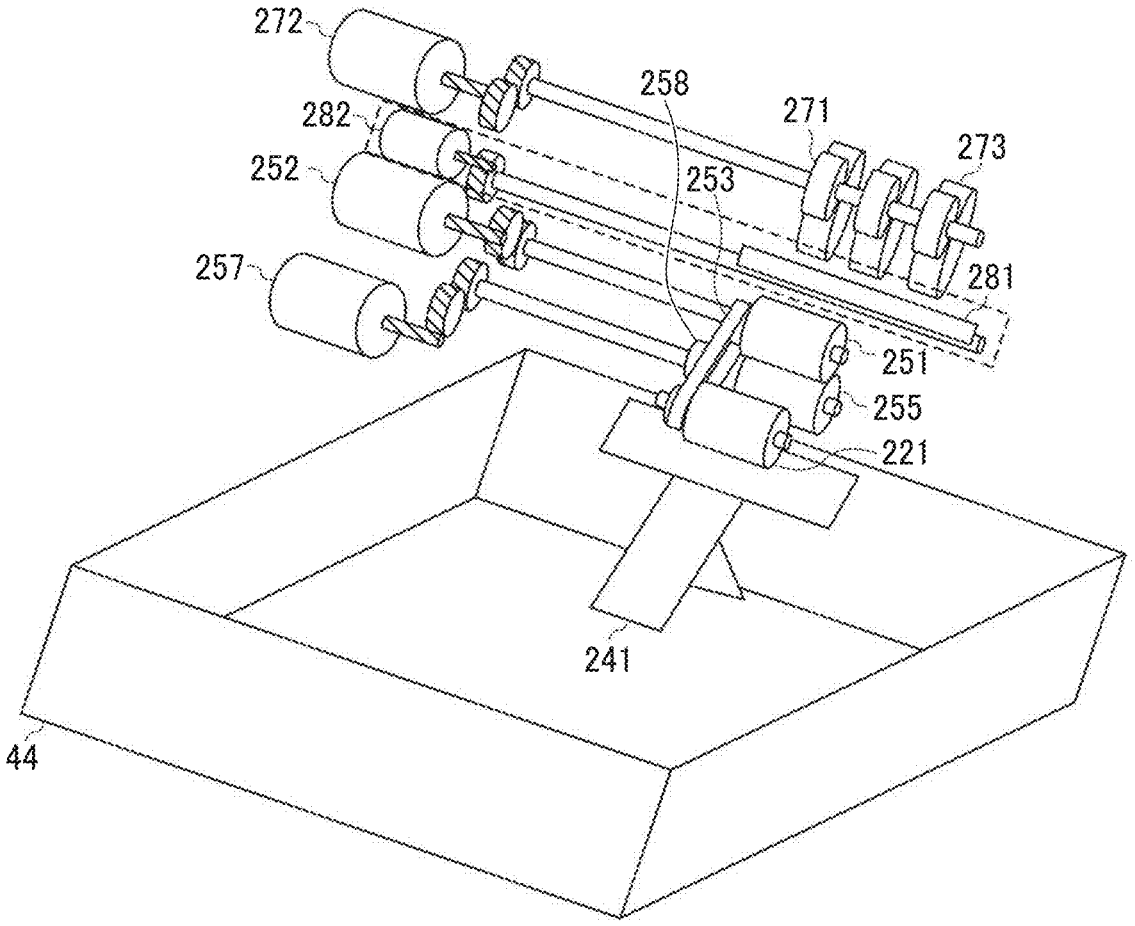
FIG. 12 is a diagram illustrating a variation of the sheet conveying device of FIG. 2.

FIG. 12 is a diagram illustrating a variation of the configuration of the sheet conveying device 200 of FIG. 2.

In addition to the configuration illustrated in FIG. 2, the sheet conveying device 200 of this variation includes a plate-like gate (contact plate) 281 and a gate drive motor 282. The leading end of the sheet contacts the gate 281. The gate drive motor 282 drives the gate 281.

The gate 281 is disposed on the sheet conveyance passage of a sheet fed from the first sheet conveyance unit. The gate 281 is changeable between a position (i.e., an attitude of the gate 281) that obstructs movement (travel) of the sheet and a position (i.e., another attitude of the gate 281) that is in parallel to the sheet conveyance guide and does not obstruct movement (travel) of the sheet.

In a case in which the position of the gate 281 is to obstruct the movement of the sheet, the leading end of the sheet contacts the gate 281. Therefore, the first sheet conveyance unit continues to feed the sheet, resulting in causing sagging of the sheet.

The gate drive motor 282 changes the gate 281 between the position to obstruct movement (travel) of the sheet and the position that is in parallel to the sheet conveyance guide not to obstruct movement (travel) of the sheet.

Figure 13:
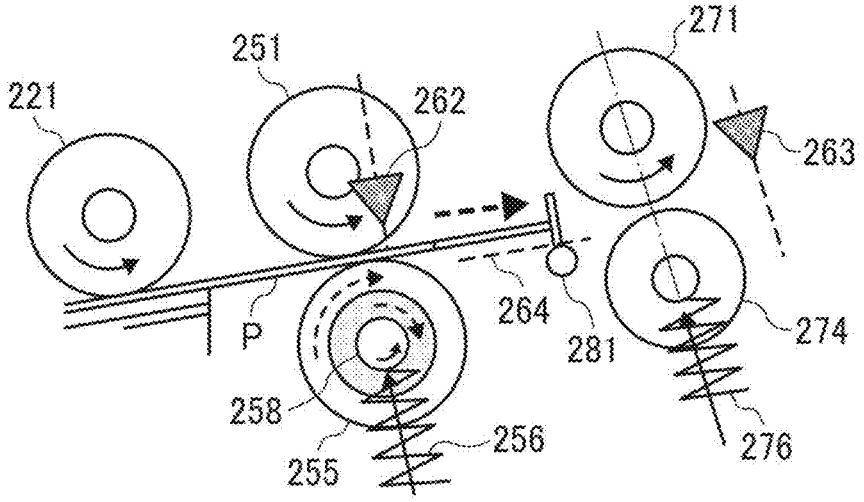
FIG. 13 is a cross-sectional view illustrating the configuration of the sheet conveying apparatus of FIG. 12.

FIG. 13 is a cross-sectional view illustrating the configuration of the sheet conveying device 200 of FIG. 12.

In addition to the configuration illustrated in FIGS. 3 and 4, the sheet conveying device 200 of FIG. 13 includes the gate 281. Further, the sheet conveying device 200 includes the sheet conveyance guide 264 having a straight shape instead of the sheet conveyance guide 261 having a curved shape illustrated in FIGS. 3 and 4.

Figure 14A:
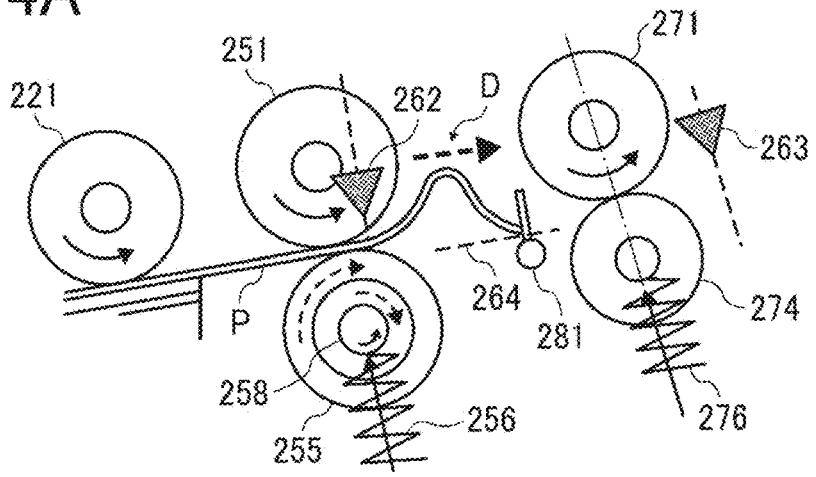
FIGS. 14A, 14B, and 14C are diagrams illustrating states of a sheet to be conveyed by the sheet conveying device of FIG. 13.
Figure 14B:
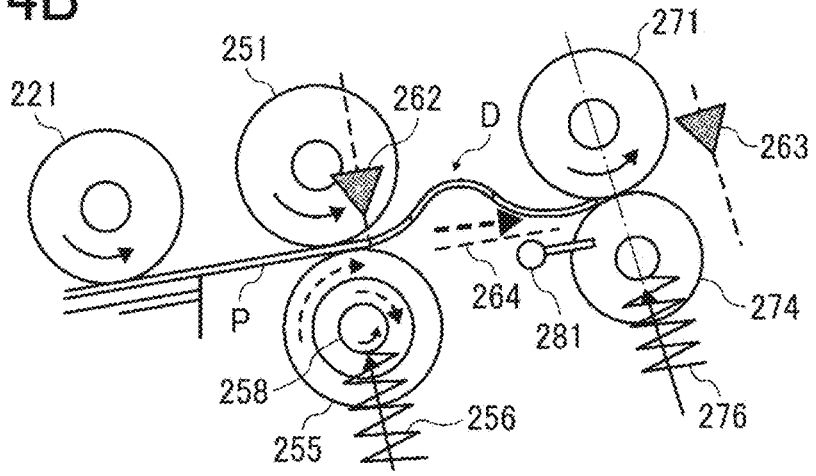
Figure 14C:
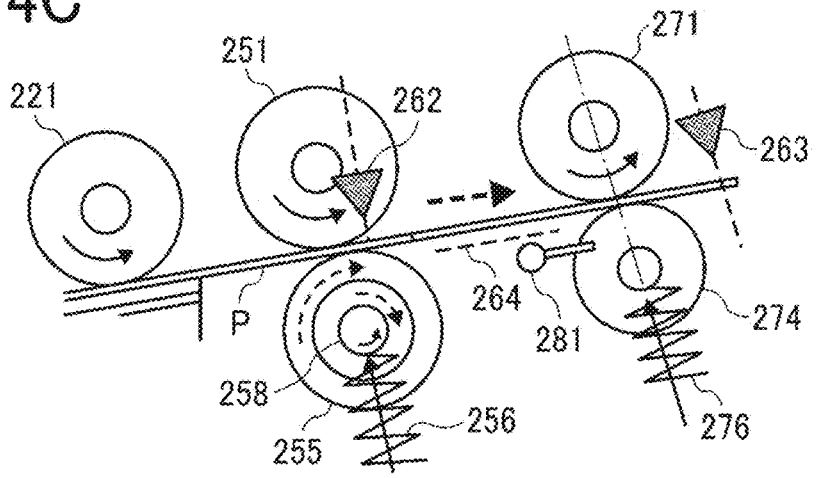

FIGS. 14A, 14B, and 14C are diagrams illustrating states of a sheet to be conveyed by the sheet conveying device 200 of FIG. 13.

As illustrated in FIG. 14A, the sheet conveying device 200 rotates the sheet feed roller 251 to cause the sheet to contact the gate 281 at the position to obstruct the sheet from moving forward, so as to cause the "sagging D" of the sheet.

Then, as illustrated in FIG. 14B, the sheet conveying device 200 changes the gate 281 to the position in parallel to the sheet conveyance guide 264 not to obstruct movement of the sheet, so that the sheet is conveyed along the sheet conveyance guide 264 toward the sheet conveyance roller 271.

Thereafter, as illustrated in FIG. 14C, the sheet is conveyed to the sheet conveyance roller 271 that has been rotating, so that the "sagging D" of the sheet is eliminated.

In this variation, as in the embodiment described above with reference to FIGS. 2 to 10, the time until "sagging of the sheet" is eliminated is set as the characteristic amount (index) as indicated in Equation 3 described below.

Equation 3.

$$t_f \approx t' = \frac{\Delta L}{V_{pf} \cdot (1-a)} = -\frac{\Delta L}{V_{pf}} \cdot \frac{1}{a-1}, \qquad \text{Equation 3}$$

where ΔL represents an amount of sagging of a sheet in a sheet conveyance passage between the sheet feed roller and the sheet conveyance roller.

Figures 15, 15A, 15B:
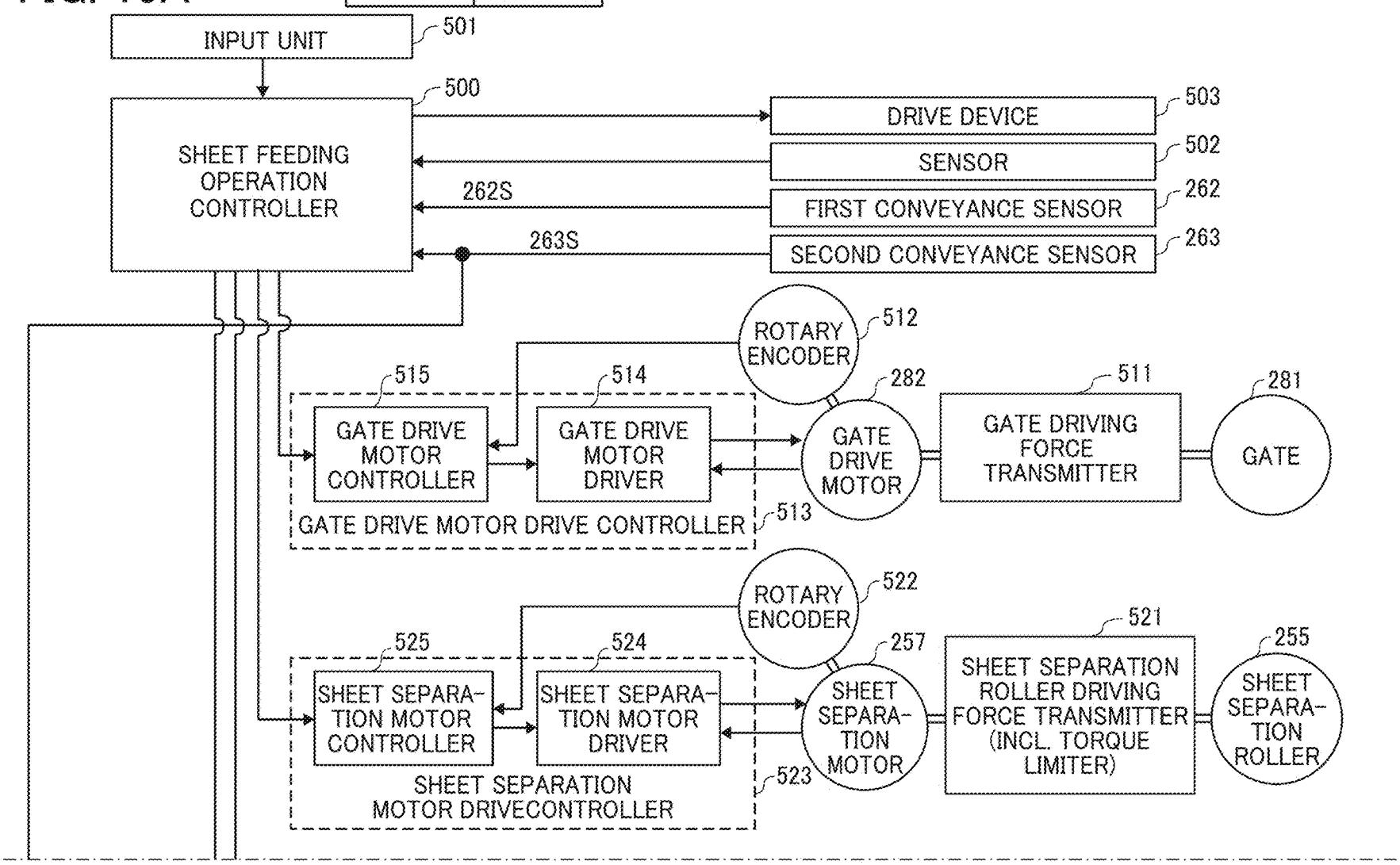
FIG. 15 including
FIGS. 15A and 15B is a block diagram illustrating a control block diagram of the sheet conveying device of FIGS. 12, 13, 14A, 14B, and 14C.
Figure 15B:
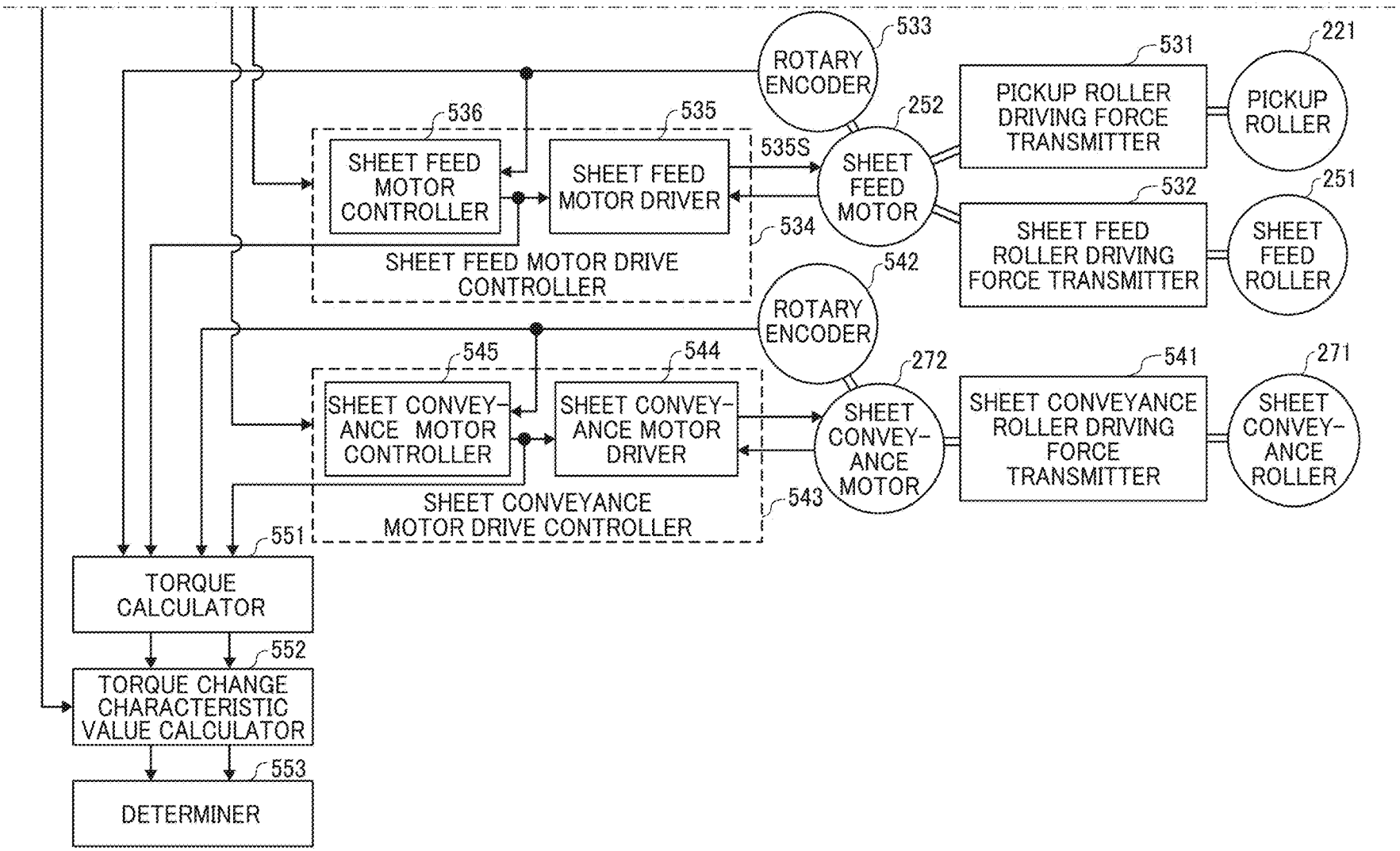

FIG. 15 is a block diagram divided into two drawing sheets of FIGS. 15A and 15B, illustrating a control block diagram of the sheet conveying device 200 illustrated in FIGS. 12, 13, 14A, 14B, and 14C.

In addition to the control block diagram illustrated in FIGS. 6A and 6B, the sheet conveying device 200 of FIGS. 15A and 15B includes a gate drive motor drive controller (contact plate controller) 513, a rotary encoder 512, and a gate driving force transmitter 511. The gate drive motor drive controller (contact plate controller) 513 drives and controls the gate drive motor 282 based on the output signal of the sheet feeding operation controller 500, so that the gate drive motor drive controller 513 adjusts the position of the gate 281. The rotary encoder 512 detects and outputs the rotation speed of the gate drive motor 282. The gate driving force transmitter 511 transmits the driving force of the gate drive motor 282 to the gate 281. The gate 281 and the gate drive motor drive controller (contact plate controller) 513 compose the sheet sagging generator. Specifically, the sheet sagging generator is disposed between the first sheet conveyance unit and the second sheet conveyance unit and is configured to cause sagging to the sheet.

The gate drive motor drive controller 513 includes a gate drive motor controller 515 and a gate drive motor driver 514. The gate drive motor controller 515 performs digital control with a microcomputer such that a signal is input from the rotary encoder 512 to rotate the gate drive motor 282 at a target speed indicated (received) from the sheet feeding operation controller 500. Then, the gate drive motor controller 515 outputs, to the gate drive motor driver 514, a signal corresponding to a voltage to be applied to the gate drive motor 282 (e.g., a PWM signal) and a signal indicating a rotational direction of the gate drive motor 282. The gate drive motor 282 outputs a Hall element signal to the gate drive motor driver 514. The gate drive motor driver 514 outputs a drive signal to the gate drive motor 282.

The gate drive motor 282 includes a motor such as a DC brushless motor. The rotary encoder 512, for example, monitor the rotation speed of the motor shaft of the gate drive motor 282 and outputs a signal (i.e., a rectangular wave signal) having a period corresponding to the rotation speed of the motor shaft of the gate drive motor 282.

The gate drive motor controller 515 performs, for example, double loop control in which the speed control is performed in the miner loop and the position control is performed in the major loop. The control method is selected from the P control, the PI control, and the PID control.

In the control block diagram of the sheet conveying device 200 illustrated in FIGS. 15A and 15B, as in the control block diagram illustrated in FIGS. 6A and 6B, the torque calculator 551 calculates the torques of the sheet feed motor 252 and the sheet conveyance motor 272, then the torque change characteristic value calculator 552 calculates the characteristic amount (index) of change of the torque before and after the sheet fed out from the first sheet conveyance unit reaches the second sheet conveyance unit, and the determiner 553 determines the sheet conveyance state based on the characteristic amount (index) calculated by the torque change characteristic value calculator 552.

In this variation, as in the embodiment described above with reference to FIGS. 2 to 10, the time until "sagging of the sheet" is eliminated is set as the characteristic amount (index), so as to determine the sheet conveyance state.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a sheet pickup body;

a first sheet conveyor including a first sheet feed roller, a second sheet feed roller and a first motor configured to rotate the first sheet feed roller;

a second sheet conveyor including a conveyance roller and a second motor configured to rotate the conveyance roller; and circuitry configured to, control a rotation timing of the first sheet feed roller and a rotation timing of the second sheet feed roller to sag a sheet between the first sheet conveyor and the second sheet conveyor, and determine a deterioration of at least one of the first sheet feed roller and the second sheet feed roller, based on at least one of (i) a torque of the first motor of the first sheet conveyor and (ii) a torque of the second motor of the second sheet conveyor, wherein the sheet pickup body, the first sheet conveyor, and the second sheet conveyor are in this order along a sheet conveyance direction, the first sheet conveyor is configured to interpose the sheet between the first sheet feed roller and the second sheet feed roller and convey the sheet to the second sheet conveyor as the first sheet feed roller rotates.

2. The sheet conveying device according to claim 1, wherein the circuitry is configured to determine the deterioration, based on torque of one motor having a greater amount of torque change, between the first motor of the first sheet conveyor and the second motor of the second sheet conveyor.

3. The sheet conveying device according to claim 1, further comprising:

a sheet conveyance guide configured to guide the sheet fed out from the first sheet conveyor, to the second sheet conveyor.

4. The sheet conveying device according to claim 3, wherein the sheet conveyance guide has an inwardly curved surface along which the sheet is conveyed.

5. The sheet conveying device according to claim 1, further comprising:

a sheet sagging generator between the first sheet conveyor and the second sheet conveyor, the sheet sagging generator is configured to sag the sheet.

6. The sheet conveying device according to claim 5, wherein the sheet sagging generator comprises:

a contact plate to which a leading end of the sheet contacts; and a contact plate controller configured to adjust an attitude of the contact plate.

7. An image forming apparatus comprising:

the sheet conveying device according to claim 1; and an image forming device configured to form an image on the sheet conveyed by the sheet conveying device.

8. The sheet conveying device according to claim 1, wherein the circuitry is configured to determine whether the deterioration of the at least one of the first sheet feed roller and the second sheet feed roller exceeds a threshold.

9. The sheet conveying device according to claim 1, wherein the circuitry is configured to determine the deterioration of the at least one of the first sheet feed roller and the second sheet feed roller based on a first index and a second index, the first index being an amount of time from the sheet reaching the conveyance roller of the second sheet conveyor to the torque of the first motor of the first sheet conveyor reaching a first threshold, and the second index being an amount of time from the sheet reaching the conveyance roller of the second sheet conveyor to the torque of the second motor of the second sheet conveyor reaching a second threshold.

10. The sheet conveying device according to claim 1, wherein the circuitry is configured to determine the deterioration of the at least one of the first sheet feed roller and the second sheet feed roller without directly considering a speed of conveyance of the sheet.

11. A sheet conveying device comprising:

a sheet pickup body;

a first sheet conveyor including a first sheet feed roller, a second sheet feed roller and a first motor configured to rotate the first sheet feed roller;

a second sheet conveyor including a conveyance roller and a second motor configured to rotate the conveyance roller; and circuitry configured to, determine a deterioration of at least one of the first sheet feed roller and the second sheet feed roller by determining an amount of time until elimination of sagging of a sheet based on at least one of (i) a torque of the first motor of the first sheet conveyor and (ii) a torque of the second motor of the second sheet conveyor, wherein the sheet pickup body, the first sheet conveyor, and the second sheet conveyor are in this order along a sheet conveyance direction, the first sheet conveyor is configured to interpose the sheet between the first sheet feed roller and the second sheet feed roller and convey the sheet to the second sheet conveyor as the first sheet feed roller rotates.

* * * * *